US006047964A

United States Patent [19]

Lawandy et al.

[11] Patent Number: 6,047,964

[45] Date of Patent: Apr. 11, 2000

[54] SCRATCH CARD, AND METHOD AND APPARATUS FOR VALIDATION OF THE SAME

[75] Inventors: Nabil M Lawandy, North Kingstown; John Moon, Cumberland, both of R.I.

[73] Assignee: Spectra Science Corporation, Providence, R.I.

[21] Appl. No.: 09/052,657

[22] Filed: Mar. 31, 1998

Related U.S. Application Data

[60] Provisional application No. 60/044,642, Apr. 18, 1997, provisional application No. 60/046,295, May 13, 1997, provisional application No. 60/050,650, Jun. 24, 1997, and provisional application No. 60/052,773, Jul. 1, 1997.

[51] Int. Cl.[7] ..... A63F 3/06

[52] U.S. Cl. ..... 273/138.1; 273/139; 283/92; 283/94; 283/100; 283/101; 283/901; 283/903

[58] Field of Search ..... 273/139, 269, 273/138.1; 283/903, 901, 85, 87, 94, 95, 101, 100, 92, 91

[56] References Cited

U.S. PATENT DOCUMENTS

| | | | |
|---|---|---|---|
| 4,359,633 | 11/1982 | Bianco | 235/468 |
| 4,736,425 | 4/1988 | Jalon | 380/59 |
| 5,109,153 | 4/1992 | Johnsen et al. | 235/468 |
| 5,239,165 | 8/1993 | Novak | 235/375 |
| 5,286,061 | 2/1994 | Behm | 283/95 |
| 5,502,304 | 3/1996 | Berson et al. | 250/271 |
| 5,521,371 | 5/1996 | Hotta et al. | 235/487 |
| 5,525,798 | 6/1996 | Berson et al. | 250/271 |
| 5,605,738 | 2/1997 | McGinness et al. | 428/195 |
| 5,633,835 | 5/1997 | Haas et al. | 368/327 |
| 5,633,836 | 5/1997 | Langer et al. | 368/327 |
| 5,699,326 | 12/1997 | Haas et al. | 368/327 |
| 5,715,215 | 2/1998 | Haas et al. | 368/327 |
| 5,719,828 | 2/1998 | Haas et al. | 368/327 |

*Primary Examiner*—Benjamin H. Layno

*Attorney, Agent, or Firm*—Ohlandt, Greeley, Ruggiero & Perle, L.P.

[57] ABSTRACT

An improved scratch card instant lottery ticket includes micro-encapsulated chemical reactants which, when released, irreversibly form one of a visual color change or a fluorescence signature at a location of the card. Both the visual color change and fluorescence signature indicate that the location has been played. Scratch cards are also marked to indicate that they have been read. Cards are marked by either automatically activating chemical reactants to form a visual color and a fluorescence signature, heating a thermofluorescent material to alter a fluorescence signature, or applying a heat-responsive material to the scratch card in such that when the identification code is read, an altered material is detected. Also taught are a method and apparatus for evaluating the scratch card to determine which locations on the card have been played. The evaluation method includes the steps of: (A) directing over at least two angles a beam of light emitted from a light source to impinge on a location of the card; (B) detecting for each of the at least two angles a component of the beam of light as it leaves the location; (C) measuring scattering angles for the location from the components detected leaving the location over the at least two angles; and (D) comparing the scattering angles of the location to a predetermined threshold, and when the angles exceed the threshold identifying the location as unplayed.

7 Claims, 23 Drawing Sheets

SCRATCH CARD, AND METHOD AND APPARATUS FOR VALIDATION OF THE SAME

CROSS-REFERENCE TO RELATED APPLICATIONS

Priority is herewith claimed under 35 U.S.C. §119(e) from copending Provisional Patent Application No. 60/044,642, filed Apr. 18, 1997, entitled "Improved Scratch Card and Reader", by Nabil M. Lawandy. Priority is also herewith claimed under 35 U.S.C. §119(e) from copending Provisional Patent Application No. 60/046,295, filed May 13, 1997, entitled "Scratch Card and Reader", by Nabil M. Lawandy. Priority is also herewith claimed under 35 U.S.C. §119(e) from copending Provisional Patent Application No. 60/050,650, filed Jun. 24, 1997, entitled "Theta-Contrast Method for Keyless Validation of Instant Lottery Tickets", by John Moon. Priority is also herewith claimed under 35 U.S.C. §119(e) from copending Provisional Patent Application No. 60/052,773, filed Jul. 1, 1997, entitled "Polarization-Contrast Method for Keyless Validation of Instant Lottery Tickets", by John Moon. The disclosure of these Provisional Patent Applications is incorporated by reference herein in their entireties.

FIELD OF THE INVENTION

The present invention relates generally to systems and methods for authenticating documents, and specifically, to methods and apparatus for validating scratch cards to enable the authentication of the card and the detection of a played scratch card ticket, as well as to improvements to the scratch card ticket to enhance the authentication of same.

BACKGROUND OF THE INVENTION

In the following text the expression "scratch card" refers to a preprinted card or ticket used, for example, as a game of chance as in an instant lottery ticket. Typically, the scratch card is purchased at a retail location for play. Play involves scratching off a removable, opaque substance from the surface of the card to reveal preprinted information concealed by the removable substance. The removable substance, such as latex, and the preprinted information are aligned on one or more locations on the card. The alignment of the one or more locations define an area on the card referred to as a game play area. The configuration of the game play area is dictated by the type of game played. The possible outcome of a game, i.e. a win or a loss, is dependent on the type of game played and the preprinted information revealed by scratching off the latex.

Currently, there are two types of instant lottery games. In the first type of game, the possible outcome of the game is determined at the time the scratch card is printed. That is, a fixed percentage of winning and losing cards are produced. The fixed percentage is assigned by the sponsor of the game. In the second type of game, referred to as probability games, a pattern of play dictates whether the card is a winner or a loser. In probability games, each card has been preprinted with a winning pattern. Winning play involves scratching off the latex of one or more locations within the game play area to reveal the winning pattern. Removing the latex from a location other than a location within the winning pattern typically results in a losing card.

It can be appreciated that for both types of games it is desirable to prevent tampering with the scratch card to determine if the card is a winner, i.e. has an intrinsic value beyond the purchase price of the card. Such tampering could involve carefully lifting the latex layer in one or more locations to observe the underlying indicia, or attempting to "see through" the latex to view the indica.

For probability games, an important validation step includes determining which locations within the game play area have been played, i.e. scratched off. The determination of played locations includes ensuring that the latex from locations not played remains intact. That is, ensuring that the latex covering locations which appear to have not been played were not, in fact, partially removed. The partial removal of latex without playing the location may be an attempt to determine whether the location is within the winning pattern. This attempt to compromise the latex layer without detection is not permissible.

There are many known ways in which the latex layers may be compromised including, for example, applying solvents to the scratch card in order to bleed the preprinted information through the scratch card, microscopic viewing of the latex in an attempt to reveal the concealed preprinted information, or various techniques which remove portions of the latex in order to read what is below it and which then replace the removed latex without detection.

In the current state of the art, numerous techniques have been employed for authenticating an item and for encoding an item to indicate a specific status. In the lottery ticket art, the determination of authenticity and play status is made by some validation system. Prior art validation systems include a manual inspection of the card wherein a retailer visually inspects the card and/or scans a bar code on the card into a lottery terminal. The retailer may also read a numeric "key" from the card which may originally have been under latex, and then enters the key into the lottery terminal. The lottery terminal and/or system to which it is connected decodes the bar code and key to determine whether the card is authentic, and for authentic cards, whether a prize should be awarded.

One disadvantage of the current validation process is the extent of manual intervention in the process, and the resulting significant time that is required to perform the validation process. Thus, there is a need for a less time-consuming, keyless validation method wherein validation is performed without the retailer entering information at the lottery terminal. Additionally, the conventional methods and apparatus are seen to generally provide authentication and marking systems. However, the prior art is not seen to teach, for example, the detection of played lottery cards. Thus, there remains a need for a reliable validation system which detects played instant lottery tickets and which limits manual intervention.

OBJECTS AND ADVANTAGES OF THE INVENTION

It is a first object and advantage of this invention to provide an improved scratch card lottery ticket which enables optical authentication and validation of the scratch card.

It is another object and advantage of this invention to provide a method and apparatus for validating scratch card lottery tickets to enable the authentication of the scratch card tickets.

It is a further object and advantage of this invention to provide a method and apparatus for validating scratch card lottery tickets to enable the detection of played scratch card tickets.

It is another object and advantage of this invention to provide a method and apparatus for validating scratch card lottery tickets by enabling the detection of latex layer tampering.

It is a further object and advantage of this invention to provide a method and apparatus for validating scratch card lottery tickets by enabling the detection of latex layer tampering through both a visual color change to the card as well as a change in a machine readable fluorescence signature.

It is another object and advantage of this invention to provide a method and apparatus for marking scratch card lottery tickets to enable the detection of played scratch card tickets.

SUMMARY OF THE INVENTION

The foregoing and other problems are overcome and the objects of the invention are realized by methods and apparatus in accordance with embodiments of this invention. More particularly, the invention is directed to a method and apparatus for validating a scratch card instant lottery ticket.

In accordance with the present invention, an improved scratch card instant lottery ticket has preprinted information arranged on at least one location of the card. The preprinted information is concealed by a removable latex layer. The at least one location defines an area on the scratch card referred to as a game play area. In one embodiment of the scratch card, one or more chemical reactants are micro-encapsulated. The micro-capsules are added to the removable latex layer such that when pressure is applied to remove a portion of the removable latex layer, i.e. to play a location, some of the micro-capsules within the removed portion burst. The burst micro-capsules release the micro-encapsulated chemical reactants to irreversibly form at least one of a visual color change that is detectable by human observation or a machine detectable fluorescence signature at the location. Both the visual color change and fluorescence signature indicate that the location has been played.

In the present invention scratch card instant lottery tickets are marked to indicate that they have been read once before. The marked ticket can be subsequently evaluated to prevent the issuance of a duplicate prize. In a first marking technique, one or more chemical reactants are added to the scratch card and, when automatically activated, the reactants irreversibly form a visual color and fluorescence signature which indicate that the card was read once before. Alternatively, a thermofluorescent material of a first fluorescence signature is added to the card. When the thermofluorescent material is heated, the first fluorescence signature is altered to a second fluorescence signature to indicate that the scratch card was read once before. In another embodiment, a heat-responsive material is applied to the scratch card in proximity to an identification code. As the identification code is read, the heat-responsive material is also detected. When heated, the heat-responsive material is altered. The altered material is detectable and indicates that the scratch card has been read once before.

The present invention also teaches a method for evaluating the scratch card instant lottery ticket to determine which locations on the ticket have been played. By detecting played locations, a play status of the scratch card is identified. Once the scratch card is identified as played the card is marked to prevent the duplicate issuance of a prize as discussed above. A first evaluation method includes the steps of: (A) directing over at least two angles a beam of light emitted from a light source to impinge on the at least one location; (B) detecting for the at least two angles a component of the beam of light as the component leaves the at least one location; (c) measuring scattering angles for the at least one location from the components detected leaving the at least one location over the at least two angles; and (D) comparing the scattering angles of the at least one location to a predetermined threshold, and wherein when the scattering angles exceed the predetermined threshold identifying the at least one location as the unplayed location. Similarly, in a second method the steps of the first method are repeated except that the beam of light is polarized and scattering angles of the beam of polarized light are measured from the components detected leaving the at least one location over the at least two angles. In a third method a first and second fluorescence image are detected. The second fluorescence image includes an area of non-fluorescence which indicates that the scratch card has been read once before.

The present invention also teaches a system for determining a play status of the scratch card instant lottery ticket by determining which of the one or more locations within the game play area on the ticket have been played. The system includes detecting and measuring devices which evaluate each of the locations within the game play area to determine which of the locations are played and which are an unplayed. Further, the system includes a devices for reading the scratch card to determine whether the scratch card has been read once before and for marking the scratch card instant lottery ticket as a played scratch card, i.e. a card which has been read once before.

BRIEF DESCRIPTION OF THE DRAWINGS

The above set forth and other features of the invention are made more apparent in the ensuing Detailed Description of the Invention when read in conjunction with the attached Drawings, wherein.

Identically labelled elements appearing in different ones of the above described figures refer to the same elements but may not be referenced in the description for all figures.

DETAILED DESCRIPTION OF THE INVENTION

Figures 1A, 1B:
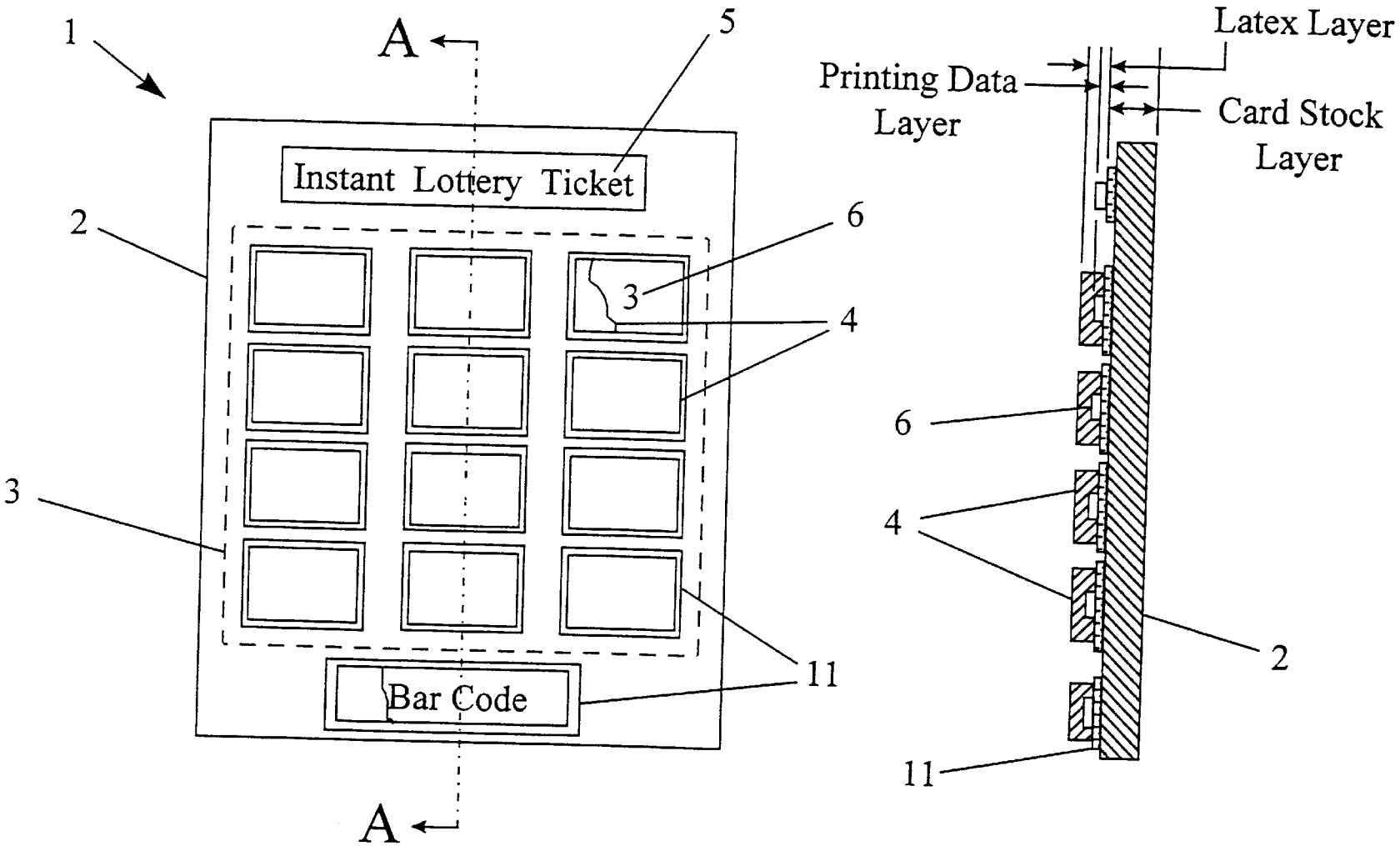
FIG. 1*a* is a plan view of a scratch card instant lottery ticket validated by the methods and apparatus of the present invention.
FIG. 1*b* is a cross-sectional view of the scratch card instant lottery ticket validated by the methods and apparatus of the present invention.

In FIGS. 1*a* and 1*b* a scratch card instant lottery ticket 1 is shown. As described above in the Background Section, play of the scratch card 1 involves removing latex 4 from the surface of the scratch card 1 to reveal preprinted indicia or information 6 concealed by the latex 4. The preprinted information 6, from at least one location within the scratch card's game play area 3, supplies information which indicates whether the card or pattern of play is a winner.

FIG. 1*b* is a cross-sectional view along line A—A of the scratch card instant lottery ticket of FIG. 1*a*. Note that in FIG. 1*b* the thickness of the scratch card is exaggerated for clarity. As shown in FIG. 1*b*, the typical scratch card 1 is comprised of multiple layers. The number of layers various according to the type of scratch card game to be produced and the printing process used. For purposes of this invention, a simplified 3 layer scratch card 1 is described. In a first layer, a paper card stock 2 is shown. In some instances, the paper card stock 2 is foil-laminated to give it a metallic appearance. The metallic appearance has both an aesthetic and functional use. The functional use is discussed below. The card stock layer may also include a plurality of acidic surface areas 11. The plurality of acidic surface areas 11 form a base for the application of a latex layer.

In a second layer, fixed and variable printing data is shown. Fixed printing data includes ticket header information 5 or display graphics which may describe or visually represent the type of game to be played. Variable printing data includes the preprinted information 6 which provides the components of the game to be played, i.e. numbers, words, or symbols used to play the game. Variable printing data may also include security or identification information, for example, unique bar codes to identify each ticket. In prior art lottery tickets, the security or identification information is typically used to authenticate the scratch card 1. The variable printing data is typically concealed by the third layer, i.e. the latex layer. When the latex 4 which comprises the latex layer is removed, the variable printing data, i.e. the preprinted information 6, is revealed. The results of the game may be determined by evaluating the preprinted information 6. While not important to the understanding of this invention, it is noted that scratch card instant lottery tickets often include additional layers of protective coatings or stylized print patterns to make the tickets more attractive or decorative, or to protect the tickets from damage.

Figure 2:
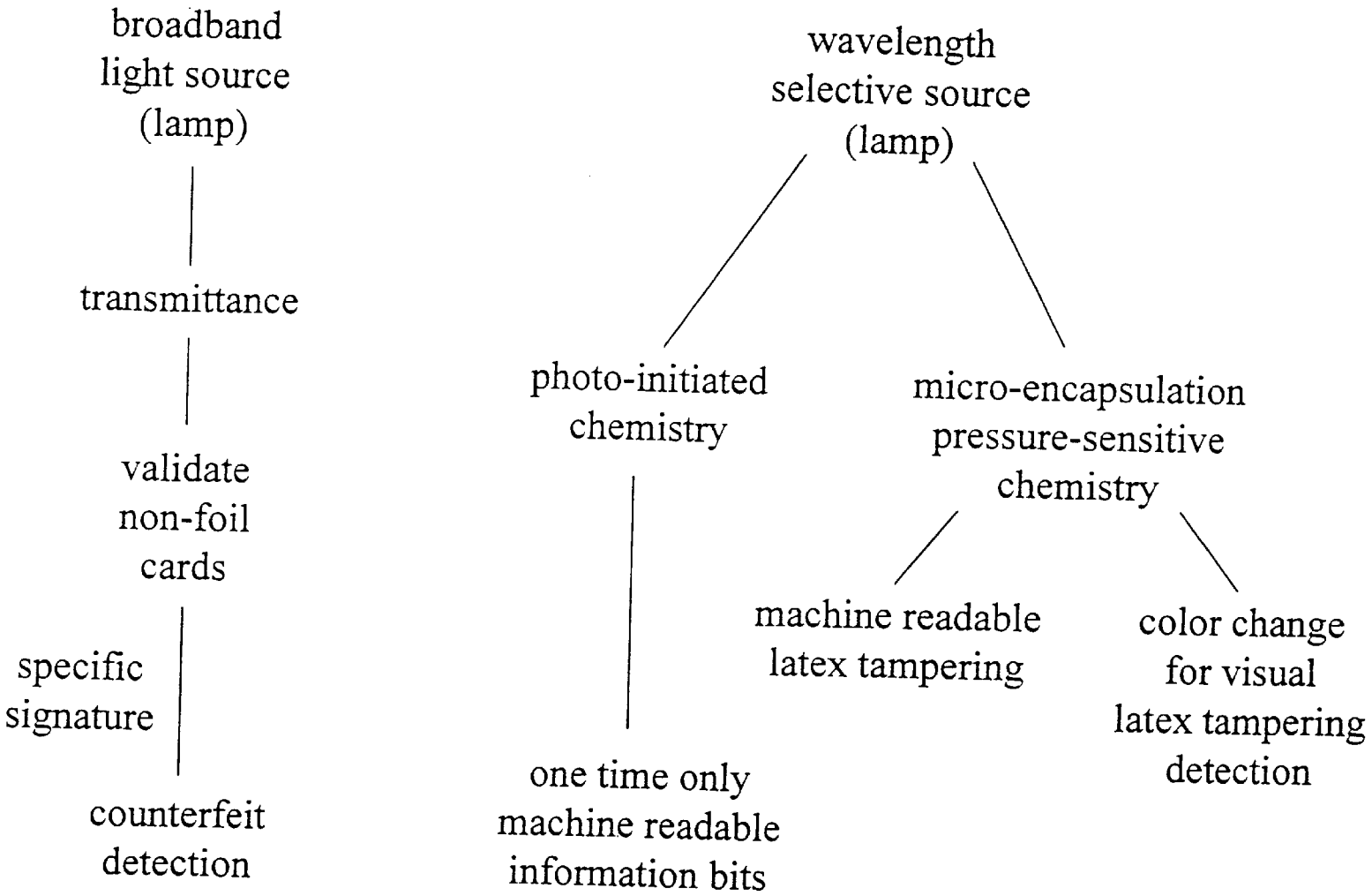
FIG. 2 is a flow chart of some of the functional aspects of an all optical scratch card validation system in accordance with the present invention.

FIG. 2 shows a flow chart of some of the functional aspects of an all optical scratch card validation system in accordance with the present invention. In the present invention, the all optical scratch card validation system authenticates both non-foil and foil type scratch card instant lottery tickets by detecting a specific optical signature of the scratch cards.

Figure 3A:
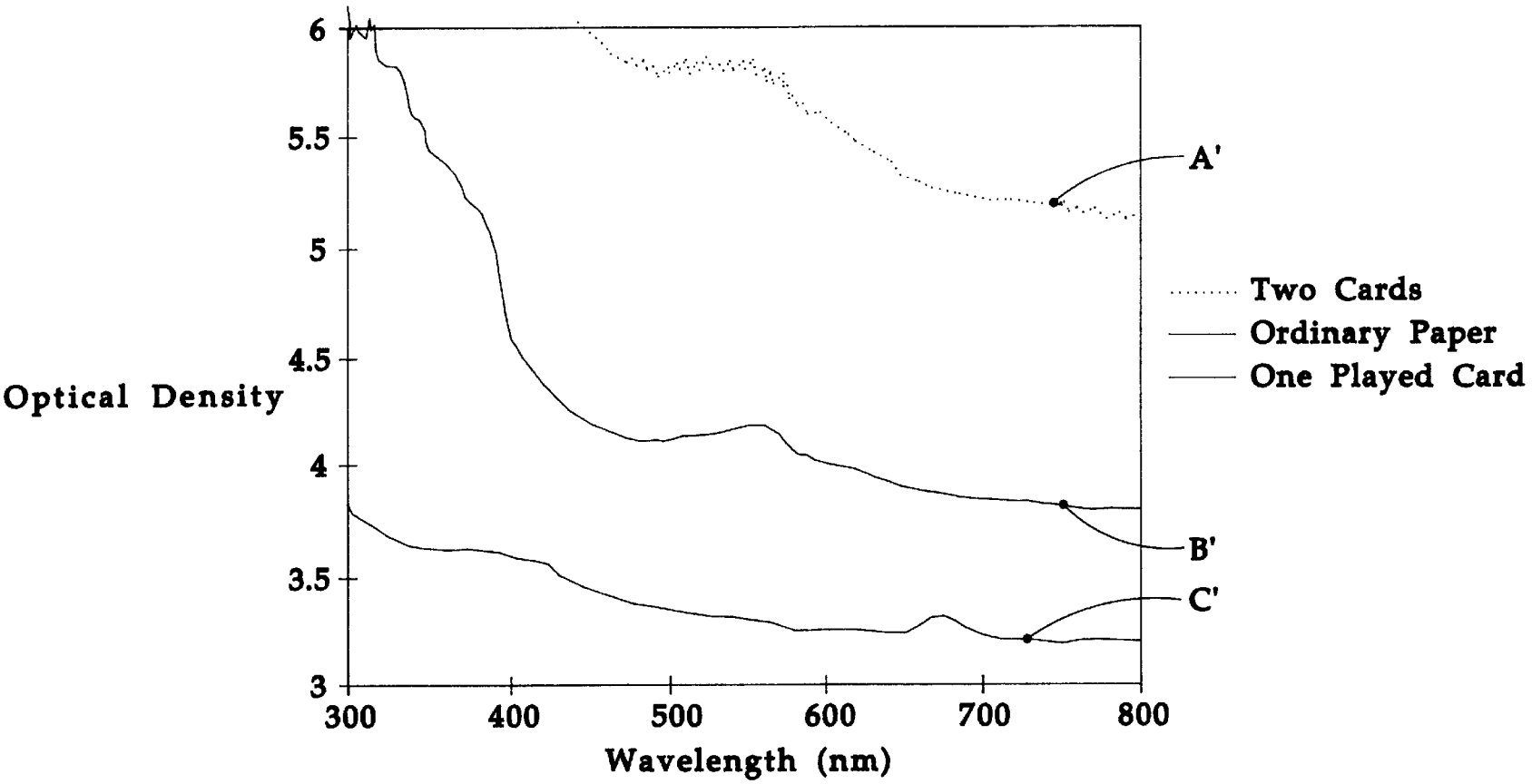
FIGS. 3*a* and 3*b* are graphs showing the optical signatures of typical scratch card instant lottery tickets.
Figure 3B:
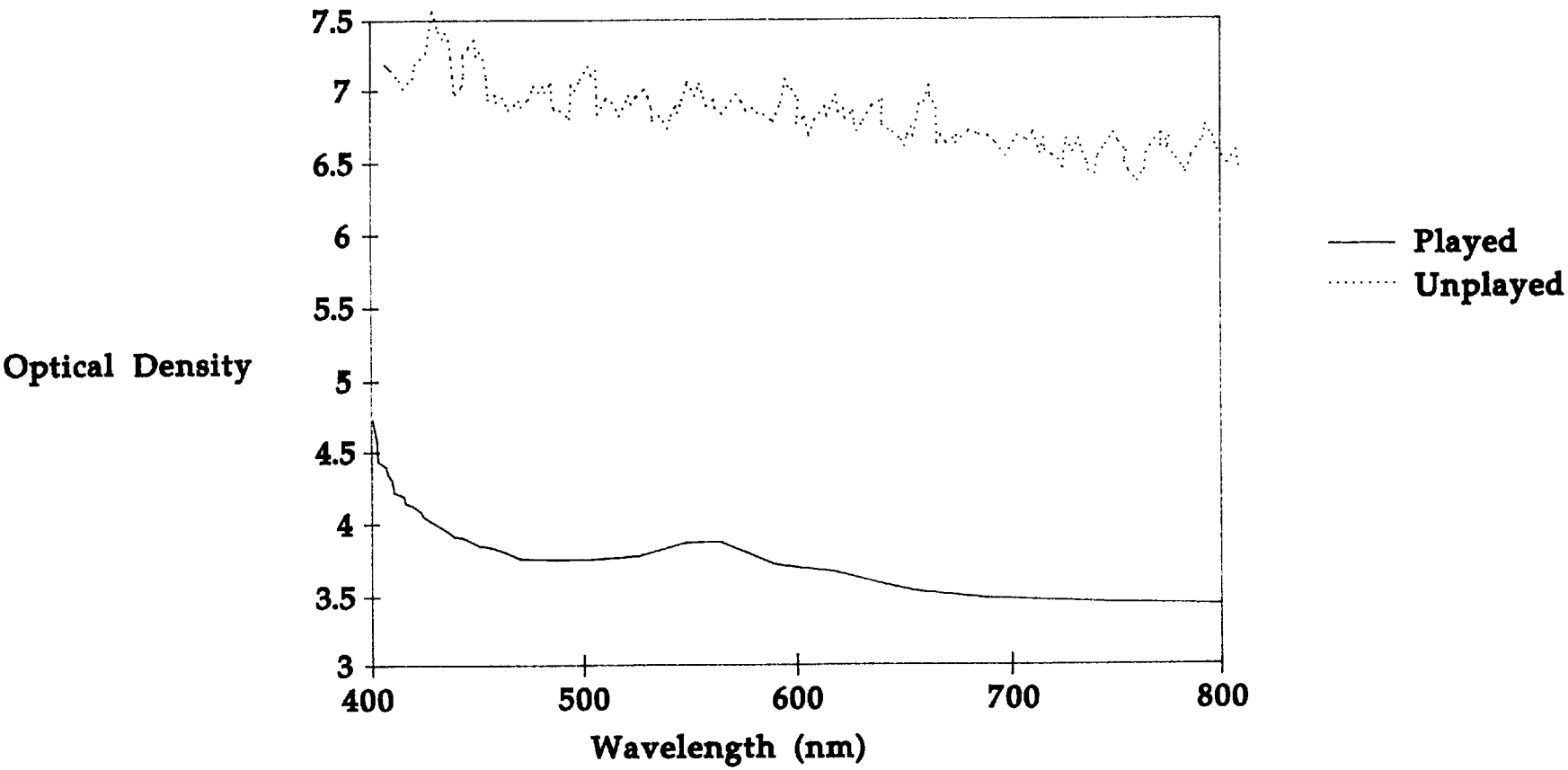

FIG. 3*b* shows typical transmission signatures of a played and an unplayed instant lottery scratch card. FIG. 3*a* shows transmission spectra, i.e. measured neutral density (ND) versus wavelength, of several scratch cards. In FIG. 3*a*, a first transmission spectrum A' represents a case where two or more scratch cards are placed in a reader simultaneously. A second transmission spectrum B' represents a case where a played scratch card is placed in a reader. A third transmission spectrum C' represents a case where a scratch card comprising non-foil paper is placed in a reader. As is shown in FIG. 3*a*, the transmission spectra (A', B' and C') are sufficiently unique to allow the identification of each of the above-mentioned cases. Thus, for example, the case where the two or more scratch cards are placed in a reader can be identified.

The ability to identify the reading of a single scratch card versus multiple scratch cards is important for a common method of determining the status of an unplayed scratch card, i.e. whether the unplayed card is a winning or a losing card, is to place a played and an unplayed scratch card into a reader simultaneously. In some keyless validation methods a reader identifies a bottom, unplayed scratch card as played by reading a certain signature, e.g., an electrical resistance, of a top, played scratch card. As a result, the reader identifies the bottom card as a played card and decodes a bar code of the bottom, unplayed scratch card to indicate whether the unplayed card is a winning card. In this manner the status of a scratch card is identified without playing the card. It can be appreciated that the determination of a scratch card's status without playing the card is undesirable.

Additionally, when it is determined that a scratch card comprised of non-foil paper is placed in a reader, light transmitted through the scratch card is imaged to determine if a winning bar code was affixed to a losing scratch card. It can be appreciated that detecting the alteration of bar codes in this manner is advantageous.

Figure 4A:
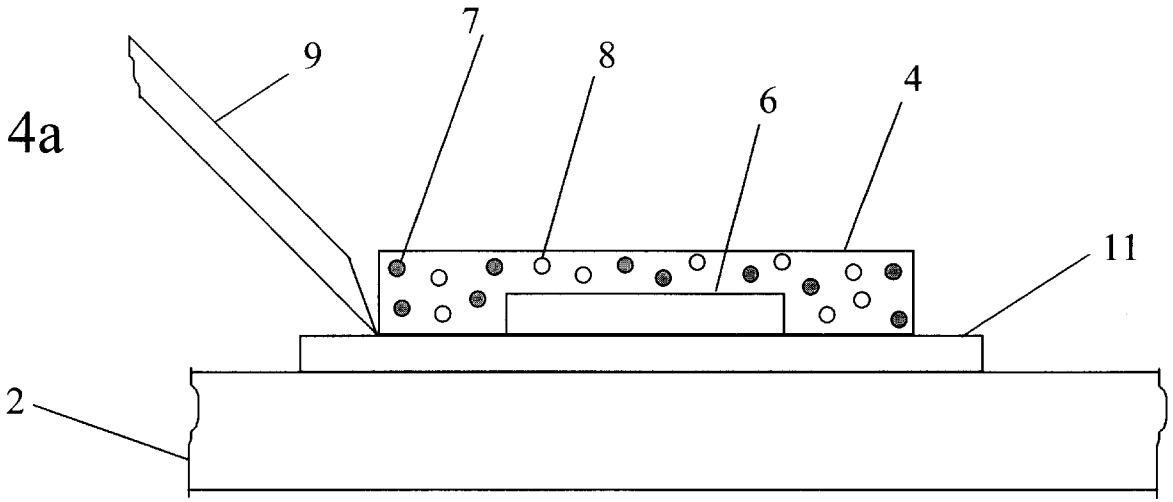
FIGS. 4*a* and 4*b* are magnified, cross-sectional views of a latex scratch-off area of the scratch card instant lottery ticket validated by the methods and apparatus of the present invention.
Figure 4B:
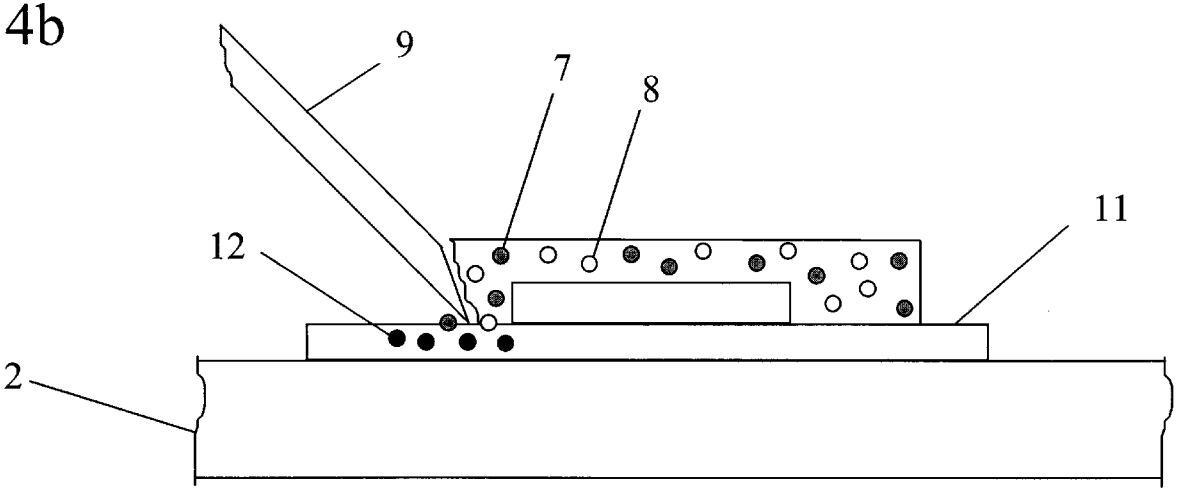

In FIGS. 4*a* and 4*b*, magnified, cross-sectional views of the 3 layers of the scratch card 1 are illustrated. In accordance with an aspect of this invention, FIGS. 4*a* and 4*b* show the result of a first micro-encapsulation technique wherein a photo-chemical change media is employed for latex layer tamper proofing. In the first embodiment, micro-capsules containing non-toxic reactants 7 and 8 are located within the latex layer to create a pressure sensitive irreversible chemical reaction which results in both a visual color change of the scratch card 1 and a machine detectable fluorescence signature. The chemical reactants, which may be initially colorless and non-fluorescent, are activated when pressure is applied by, for example, a knife edge 9, a coin or a finger tip that is used to lift or prick the latex layer. FIG. 4*a* shows the latex 4 before the pressure applied by the knife edge 9 removes any latex 4. In FIG. 4*b,* the knife edge 9 is shown applying pressure capable of removing the latex 4 from a location in the card's game play area 3. The applied pressure of, for example, 100 lbs./sq. in. is sufficient to break the micro-capsules and activate the chemical reactants 7 and 8 to form a fluorescent colored dye 12. The fluorescent colored dye 12 irreversibly alters the color and fluorescence signature of the location thus identifying the location as a played location. The fluorescent colored dye 12 is detectable by a visual inspection of the scratch card 1 performed by the retailer, while the fluorescence signature of the played location is detectable by a machine.

Figure 5:
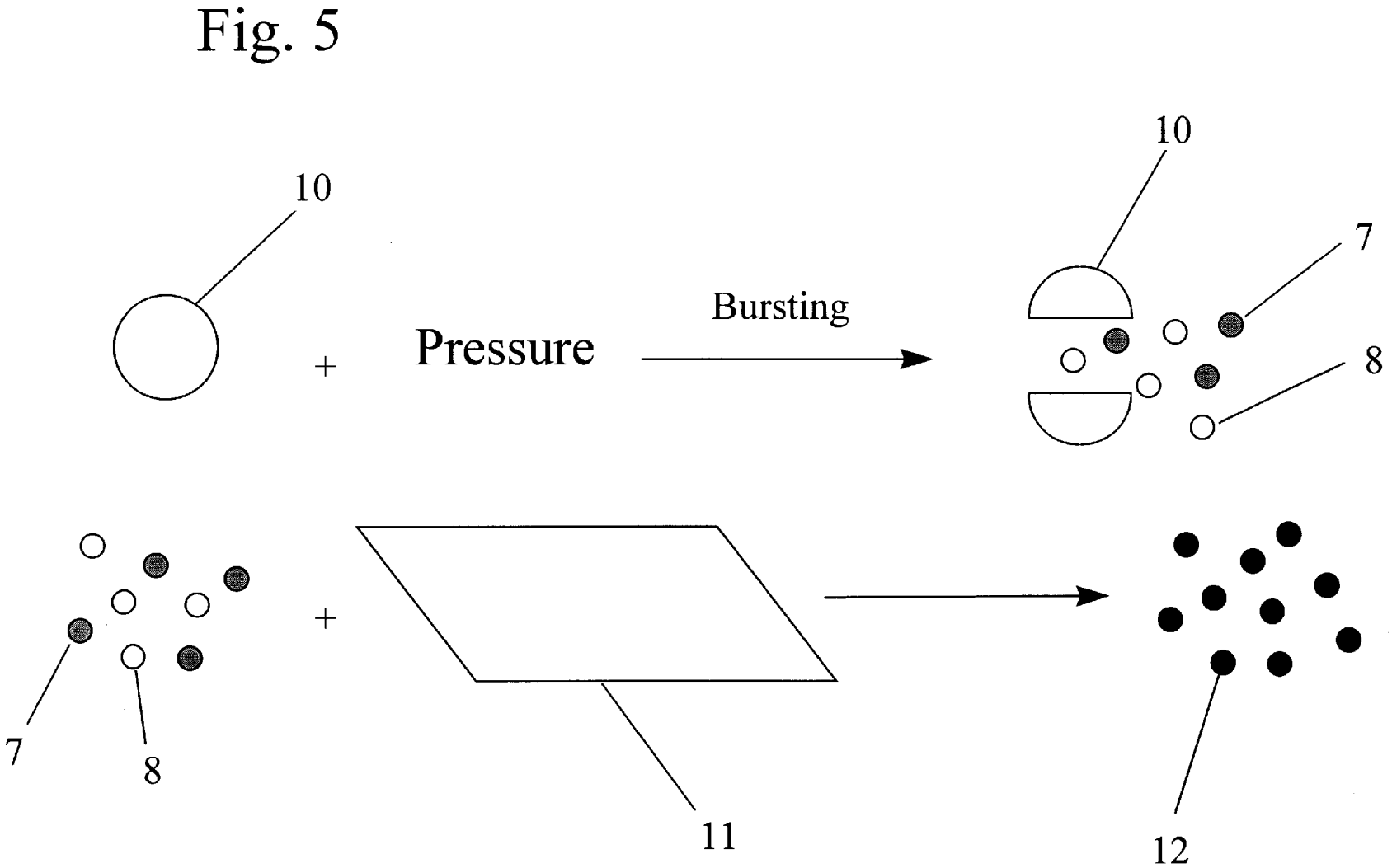
FIG. 5 is a block diagram of a pressure activated micro-encapsulation technique according to the present invention.

More particularly, and as is shown in FIGS. 4*a,* 4*b* and 5, the pressure applied by the knife edge 9 removes a portion of the latex 4 concealing the preprinted information 6. The pressure from the knife edge 9 bursts some of a plurality of micro-capsules 10 within the removed portion of the latex 4, which micro-encapsulate the chemical reactants 7 and 8. Preferably, each of the plurality of micro-capsules 10 is, for example, a plurality of polystyrene or gel capsules of between 3 to 5 $\mu$m in diameter. Activation of the chemical reactants occurs when the reactants, for example a colorless dye lactone 7 and a solvent 8, are released by the bursting of some of the plurality of micro-capsules 10 to contact an acidic surface area 11 disposed on the paper card stock 2. As is shown in FIGS. 4*a* and 4*b,* chemical reactants 7 and 8 are each individually micro-encapsulated by micro-capsules 10. As such, activation of the chemical reactants occurs when some of the plurality of micro-capsules 10 containing, for example, the colorless dye lactone 7 and some of the plurality of micro-capsules 10 containing, for example, the solvent 8 burst releasing the chemical reactants to contact the acidic surface area 11. In another embodiment, shown in FIG. 5, chemical reactants 7 and 8 are each micro-encapsulated by a micro-capsule 10. In this embodiment, activation of the chemical reactants occurs when some of the plurality of micro-capsules 10 containing, both the colorless dye lactone 7 and the solvent 8 burst releasing the chemical reactants to contact the acidic surface area 11.

Once activated, the colorless dye lactone 7 and the solvent 8 interact to form the fluorescent colored dye 12. For example, the colorless dye lactone is Rhodamine B base or Methylene Blue, and the acidic surface is fumed silica or acidic clay. When activated, the reactants produce the fluorescent colored dye 12 whose color is visible to human observation and whose fluorescent signature is detectable by machine. As a result, the validation process of the present invention detects any effort to remove the latex from a location within the game play area 3 of the scratch card 1 by irreversibly identifying the location as a played location.

In a second, alternate embodiment for latex layer tamper proofing, a fluorescent dye is micro-encapsulated within a plurality of opaque capsules. The opaque capsules inhibit detection of a fluorescence signature of the fluorescent dye. Each of the plurality of opaque capsules is disposed within the latex layer of the scratch card. As pressure is applied to remove the latex 4 from the at least one location within the game play area of the scratch card, some of the plurality of opaque capsules within a removed portion of the latex layer burst. The bursting of some of the plurality of opaque capsules causes the release of the fluorescent dye. As a result of the releasing of the fluorescent dye, a visual color change and a machine detectable fluorescence signature is made apparent to identify the location as a played location. As in the first embodiment, each of the plurality of opaque capsules employed in the second embodiment is, preferably, one of a plurality of polystyrene capsules. Additionally, each of the plurality of opaque capsules is between 3 to 50 $\mu$m in diameter.

Figure 6A:
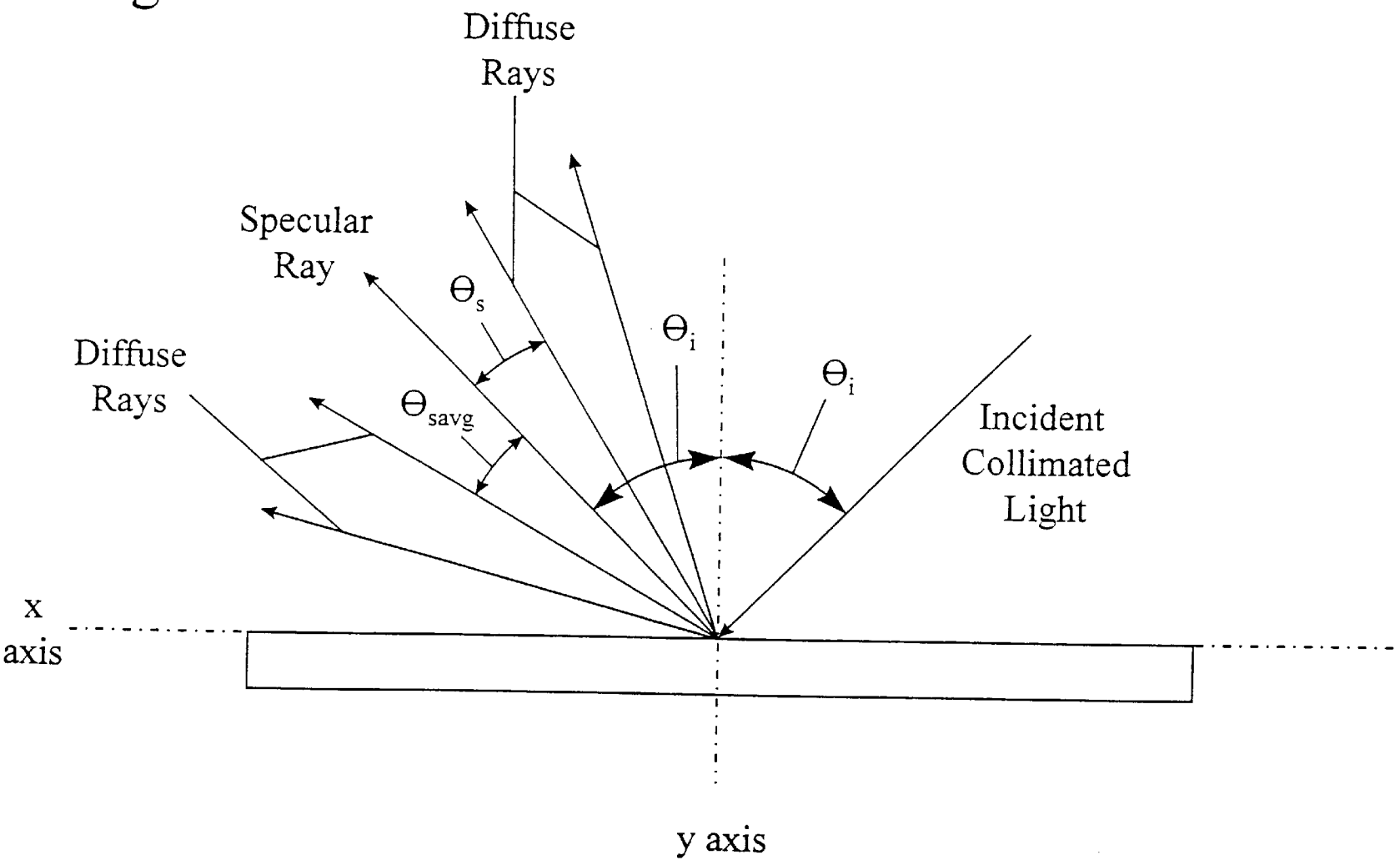
FIG. 6*a* is a two-dimensional, conceptual view of specular and diffuse rays reflected by a reflecting surface.
Figure 6B:
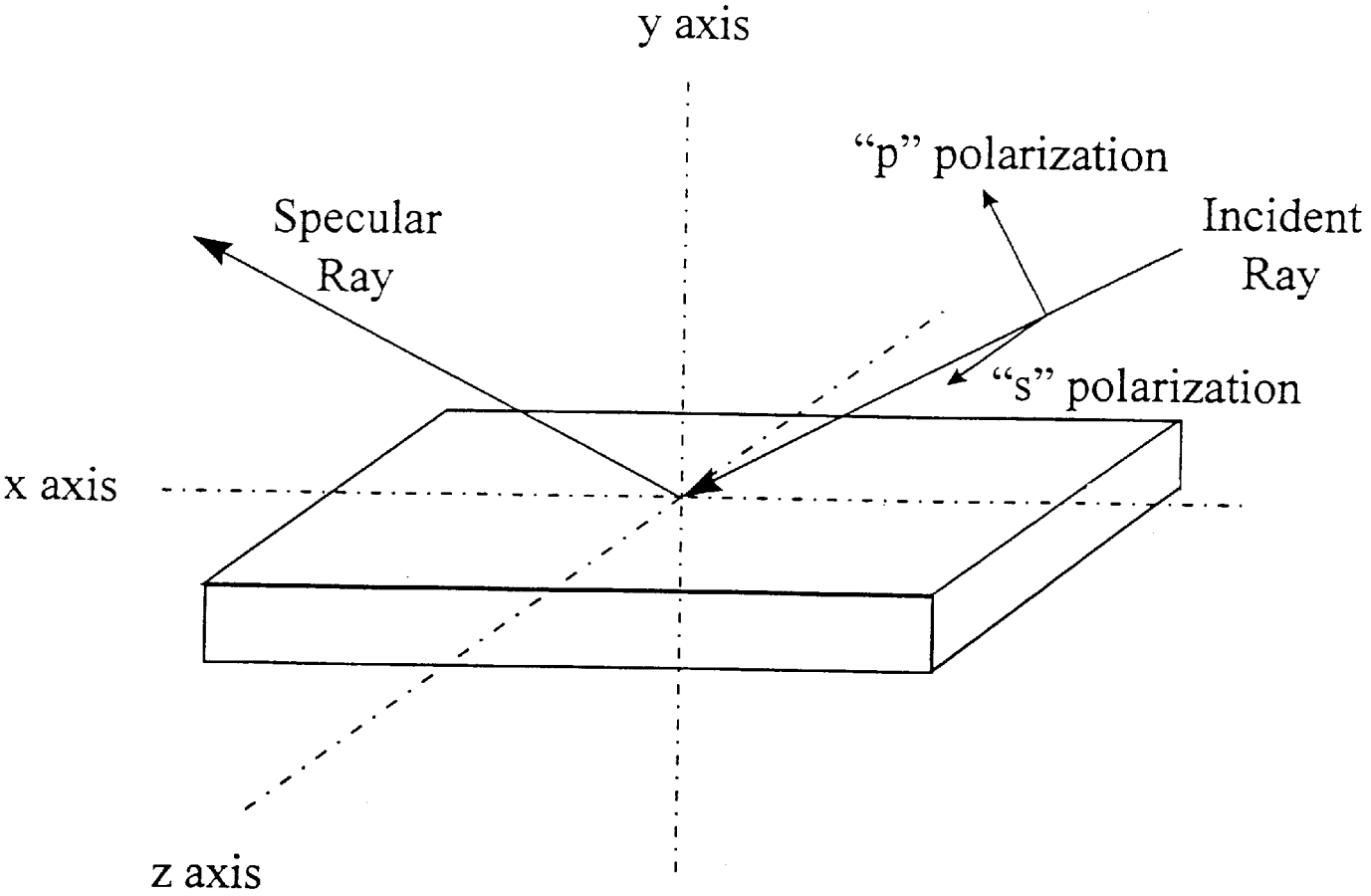
FIG. 6*b* is a three-dimensional, conceptual view of specular rays of a given polarization reflected by a reflecting surface.

In FIGS. 6*a* and 6*b,* the typical properties of light rays, when the light rays impinge on and leave a surface, are shown. FIG. 6*a* shows that one effect of impinging light on a surface is that the angle of the light rays may change giving rise to a diffuse component and a specular component of light leaving the surface. Impinging light on a surface that is "shiny" results in a large specular component. The specular component is composed of rays which leave the surface at the same angle at which they impinge on the surface. On the contrary, impinging light on a surface which is "dull" results in a large diffuse component leaving the surface. Diffuse components are characterized by a large range of scattering angles for light leaving the surface. In FIGS. 6*a* and 6*b,* a collimated beam is shown impinging a surface. In particular, FIG. 6*a* shows the specular and diffuse components of the collimated beam leaving the surface. In FIG. 6*a,* the incident collimated light impinges on the surface at an angle $\theta_i$, therefore the specular component leaves the surface at the same angle $\theta_i$. The diffuse components of the collimated beam, however, leaves the surface at different angles. The different angles are represented on FIG. 6*a* by an angle $\theta_s$, which is an angle between the diffuse component and the specular component. Thus, $\theta_s$ represents the various scattering angles for light scattered from the surface.

As discussed above, the paper card stock 2 may be foil-laminated to give it a metallic appearance. The foil-laminating thus makes the surface of paper card stock 2 a substantially specular surface. Therefore, an incident light ray impinging the foil surface of the paper card stock 2 would produce a large component of specular light. However, if the foil surface of the paper card stock 2 were covered with a non-specular layer, for example, the latex layer, then a larger diffuse component would be present.

It is noted that a fundamental property of all latex-based scratch-off tickets is a common surface texture of the paper card stock 2 under the latex layer. To facilitate the scratch-off and remove of the latex layer, the surface texture of the underlying layer is typically smooth. The latex layer, on the other hand, is a "dull" surface and so results in a diffuse component of impinging light due to an inherent roughness of the latex 4. Thus, by measuring the angular scattering of the rays leaving the surface, i.e. each $\theta_s$ as shown in FIG. 6*a,* characteristics of the surface are determined. For example, a small average scattering angle of, for example about 1 degree, is characteristic of a shiny, played surface area of a location within the card's game play area 3, while a larger average scattering angle of, for example about 5 to 10 degrees, is characteristic of a dull, unplayed location (i.e., the presence of the latex layer 4).

Figure 7:
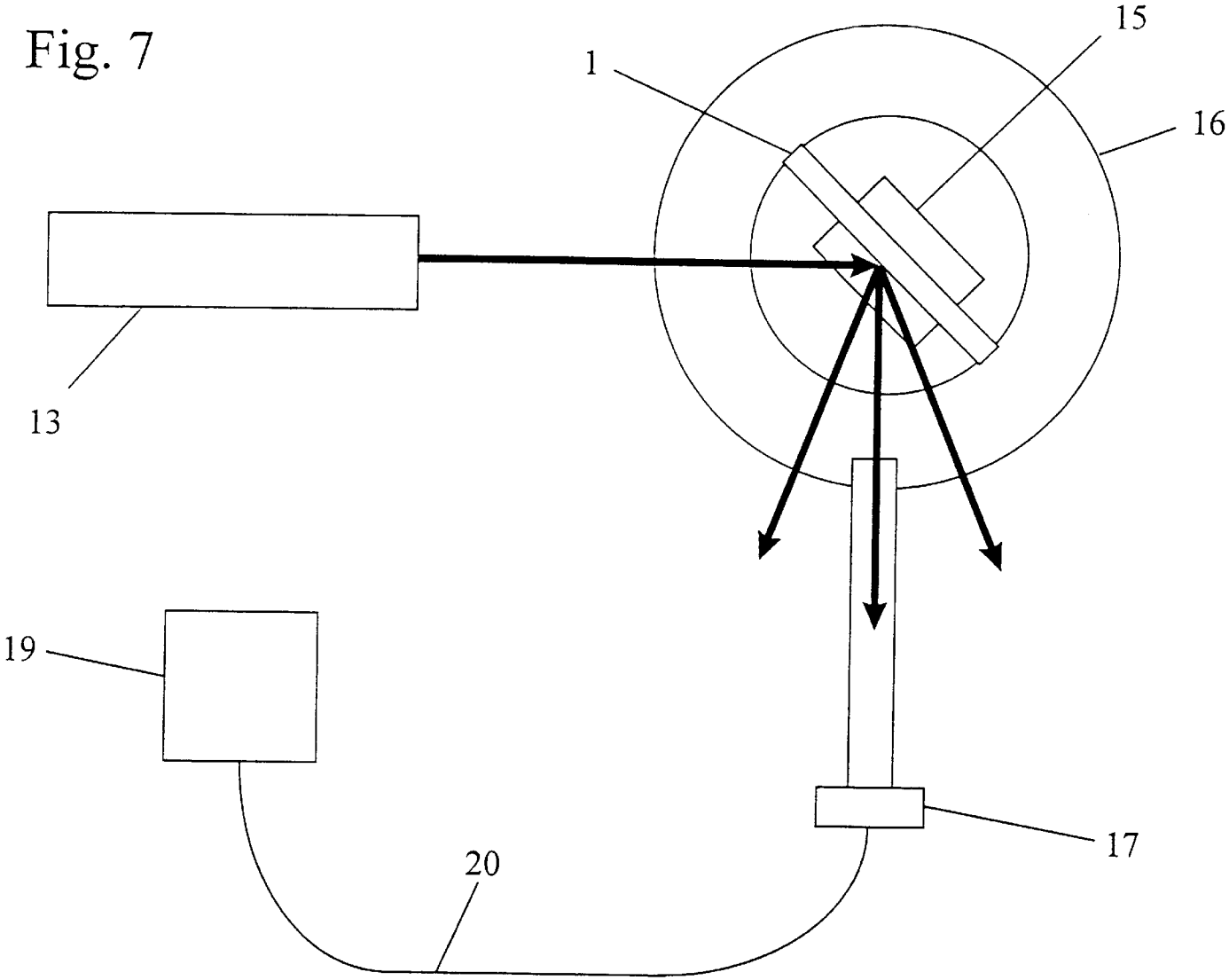
FIG. 7 is a schematic diagram of a first embodiment of an apparatus for measuring scattering angles according to the present invention.

In FIG. 7 a plan view of an apparatus for evaluating the scattering angles of light leaving one or more locations on the surface of the instant lottery scratch card 1 is shown. The apparatus includes a light source such as a laser diode 13, a mount 15 to hold the scratch card 1, a rotation stage 16 with a fiber optic receiver 17 mounted to an arm of the stage, and a remote detector 19.

The laser diode 13 emits a beam of light which impinges on the one or more locations of the scratch card 1. As the stage 16 is rotated, a portion of the light impinging the one or more locations of the scratch card 1 is detected by the fiber optic receiver 17 as it leaves the surface of the card. The fiber optic receiver 17 passes the detected portion of light to the remote detector 19 via a fiber optic coupling, for example, a fiber optic cable 20. The remote detector 19 monitors the detected portion of light and measures the angular scattering of the detected portion of light leaving the one or more locations of the scratch card 1. In this way, the detected portion of the light leaving the scratch card 1 is measured at a number of different angles.

It is noted that the portion of light detected by the fiber optic receiver 17 increases as the angle of reflectance converges on the angle of incidence. Similarly, the portion of light detected decreases as the angle of reflectance diverges from the angle of incidence. Therefore, in a more specular surface the detected portion of light leaving the one or more locations of the surface of the scratch card 1 is concentrated about angles substantially equal to the angle of incidence at which the emitted beam of light impinges on the one or more locations of the scratch card 1.

It is also noted that the apparatus of FIG. 7 and the scattering angles detected leaving the one or more locations of the scratch card 1 are used to determine, for example, an average scattering angle, $\theta_{savg}$, of the one or more locations of the instant lottery scratch card 1. In an embodiment of the invention in which the game play area 3 of the scratch card 1 includes one location containing the preprinted information 6 concealed by the latex 4, the average scattering angle, $\theta_{savg}$, is compared to a predetermined threshold. If $\theta_{savg}$ is found to exceed the predetermined threshold, then the one location is identified as an unplayed location. In another embodiment in which the game play area 3 includes more than one location containing the preprinted information 6 concealed by the latex 4, $\theta_{savg}$ of each of the more than one locations may also be compared to the predetermined threshold. Alternatively, $\theta_{savg}$ of each of the more than one locations may be compared to another of the more than one locations. This relative comparison of $\theta_{savg}$ values may then be used to identify each of the more than one locations as either as a played location or as an unplayed location.

The relative difference in the average scattering angles, $\theta_{savg}$, for played and unplayed locations were determined for a number of existing lottery scratch cards. In many cases it was determined that the relative difference in average scattering angles between the played and the unplayed locations was greater than 5 degrees.

Table #1 summarizes the experimental results of the average scattering angles for three card titles. It is noted that the card entitled "5 Card Cash" in Table #1 represents a worst case difference that was measured between the average scattering angles of played versus unplayed locations. By worst case it is meant that a difference between the average scattering angles of less than 5° was measured. It is noted, however, that the worst case difference in average scattering angles for played versus unplayed locations on the "5 Card Cash" scratch card is still a detectable difference of 2.2°.

TABLE 1

Card titles and average scattering angles.

| Card Title | $\theta_{savg}$, Latex Removed | $\theta_{savg}$, Latex Present |
|---|---|---|
| Olas de Suerte | 0.95° | 8.8° |
| Fail Safe | 1.4° | 6.7° |
| 5 Card Cash | 3.1° | 5.3° |

Figure 8:
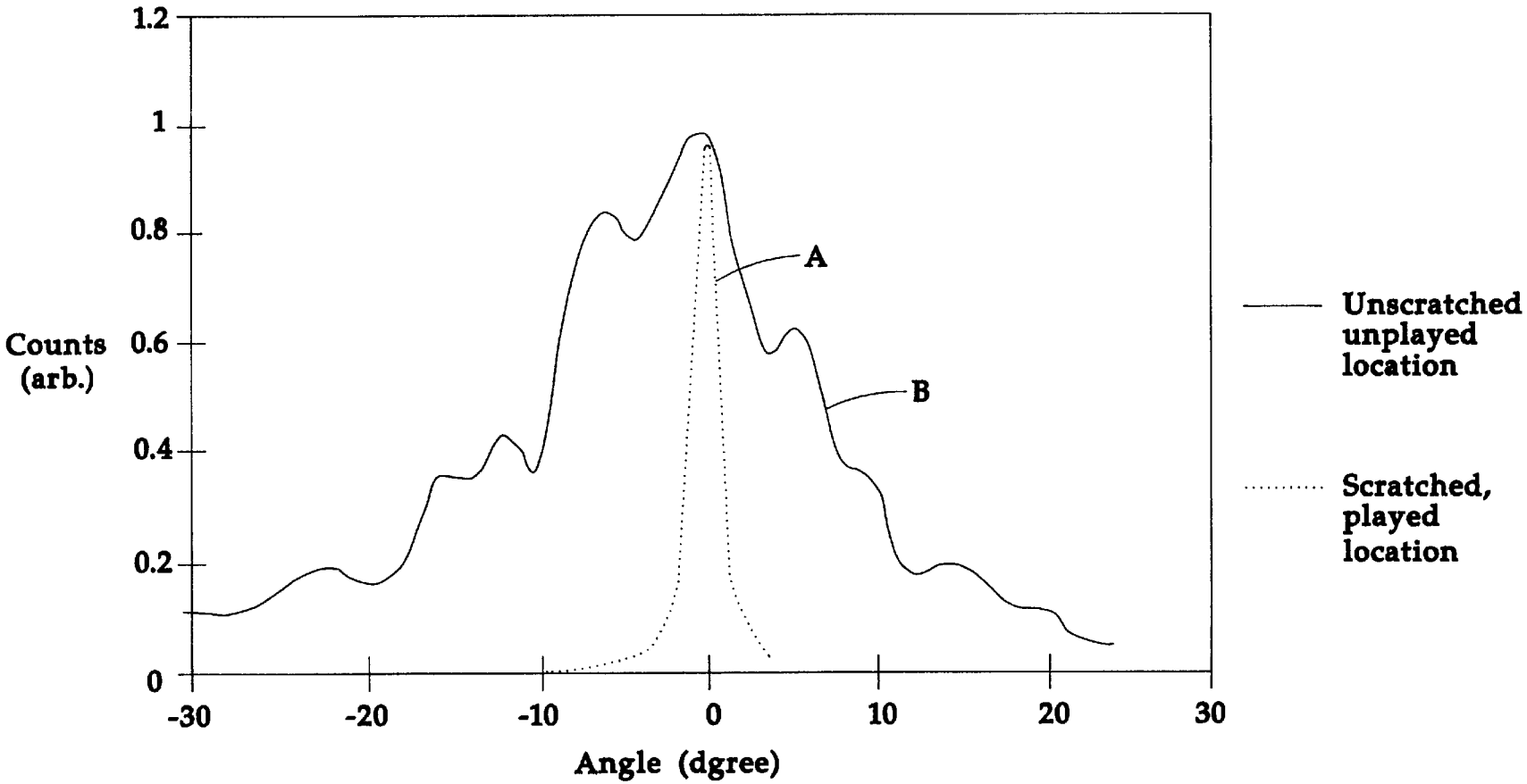
FIG. 8 is a graph of scattering angles of a typical scratch card instant lottery ticket.

In FIG. 8, scattering angles detected from light leaving a location with the game play area 3 of a representative scratch card, the "Olas de Suerte" card, is graphically shown. In particular, FIG. 8 illustrates that a substantial change in the average scattering angle $\theta_{savg}$ is seen between the two plotted signals. The first plotted signal, labelled "A", represents the reflection characteristics of a shiny, played location of the scratch card 1. The second plotted signal, labelled "B", represents the reflection characteristics of a dull, unplayed location of the scratch card 1. As is illustrated in FIG. 8, and as discussed above, it can be appreciated that the average scattering angle, $\theta_{savg}$, for the shiny, played location is concentrated about angles substantially equal to the angle of incidence of the collimated beam, and therefore values of $\theta_{savg}$ are measured to be substantially equal to 0°.

It was determined through experimentation utilizing the apparatus as shown in FIG. 7 that the specular reflection from the played, shiny locations within the surface of the scratch card's game play area 3 gives a reflection on the order of 50–100 times that of the diffuse reflection from the unplayed, dull latex covered locations. It is assumed that a remote detector 19 for the apparatus of FIG. 7 is typically a commercially inexpensive camera. The information detected by most inexpensive, commercially available cameras is converted to a digital number represented by, for example, 8-bits. Therefore, most inexpensive, commercially available cameras have 8-bits of dynamic range, e.g., the digital number is an 8-bit number.

That is, that by employing a camera with 8-bits of dynamic range, signals separated in amplitude by more than a factor of 256, i.e. two to the eighth power ($2^8$), can not be resolved. For example, if the sensitivity of a camera is set to detect signals of a first amplitude, then signals of a second, larger amplitude would saturate a digital converter within the camera if the second amplitude was more than a factor of 256 greater than the first amplitude. Conversely, if the sensitivity of the camera is set to detect signals of the second, larger amplitude, then signals of the smaller, first amplitude that were more than a factor of 256 less than the second amplitude would not be detected at all. Ideally, as can be appreciated from the above discussion, the signals to be detected should be of comparable amplitudes.

If the signals to be detected are not of comparable amplitudes, then one may measure the scattering angles of both the played and unplayed locations by adjusting the illumination intensity between the measurements of the unplayed and the played locations. For example, the illumination intensity may be adjusted during separate angular scans, or multiple cameras may be provided for evaluating different illumination intensities at different wavelengths. The use of either separate scans or multiple cameras, however, may not be desirable for some applications.

It has been determined that by adding a first polarizer 14 and a second polarizer 18 to the apparatus of FIG. 7, the dynamic range of measurements for the specular and the diffuse reflections can be brought within the 8-bit range of conventional cameras. Thus, in FIG. 9 an apparatus is shown wherein the first polarizer 14 and the second polarizer 18 are inserted into the illuminating light path of the laser 13, at points before and after the scratch card 1. optionally, the first polarizer 14 and the second polarizer 15 may be variable or rotatable polarizers.

Figure 9:
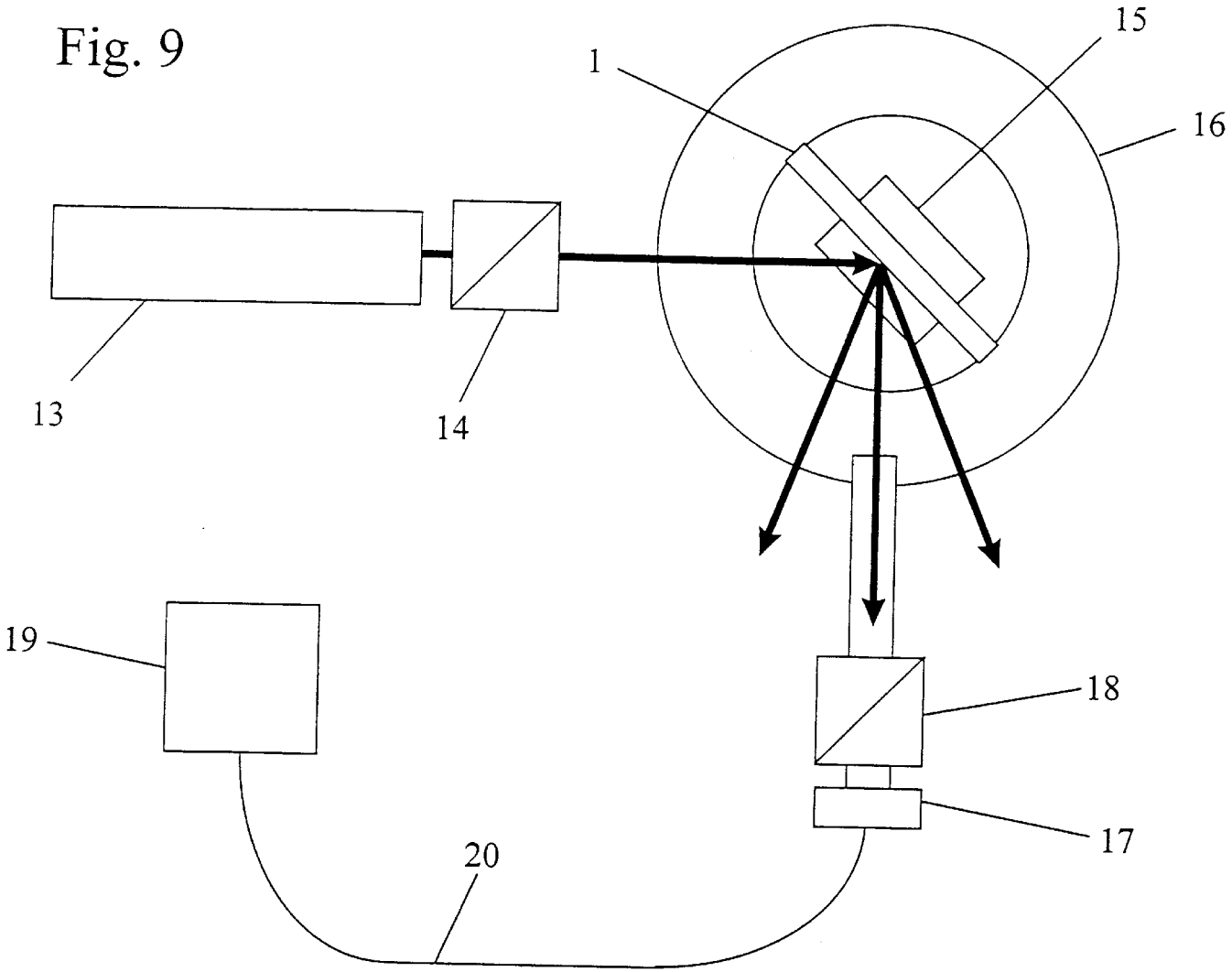
FIG. 9 is a schematic diagram of a second embodiment of an apparatus for measuring scattering angles for a beam of polarized light according to the present invention.
Figure 10:
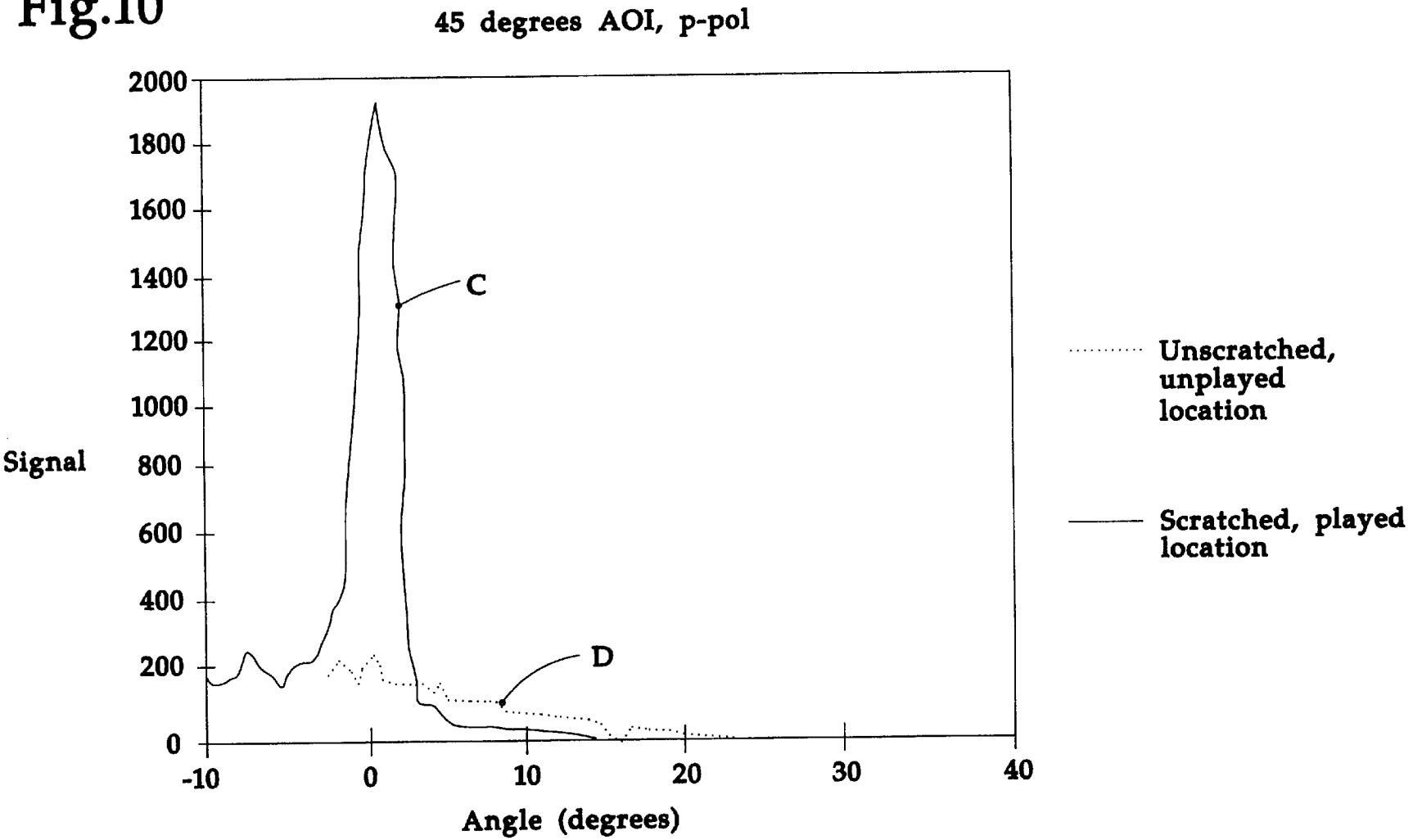
FIG. 10 is a graph of scattering angles taken with "p" incident polarization.

The apparatus of FIG. 9 measures the scattering angles of the polarized light detected leaving one or more locations within the game play area 3 of a scratch card 1. The measured scattering angles of the polarized light are evaluated to identify the one or more locations under evaluation as either played locations or unplayed locations. The apparatus of FIG. 9 was used to measure scattering angles for an exemplary scratch card instant lottery ticket. These angular scattering measurements are illustrated on FIG. 10. FIG. 10 shows that by employing the embodiment of FIG. 9, the peak amplitudes of the signals of the angular scattering of polarized light detected from a played location (the signal labelled "C") and from an unplayed location (the signal labelled "D") lie within a factor of about 8 (3-bit dynamic range), and thus within the factor of 256 (8-bit dynamic range) of most inexpensive, commercially available cameras.

Referring again to FIG. 6*b,* it is noted that when light is reflected from a specular surface near Brewster's angle there is a strong polarization dependence to the reflected light. This is demonstrated graphically on FIG. 6*b* with reference to a "p" and a "s" polarization. That is, where "p"represents the perpendicular component of polarization and "s" represents the polarization parallel to the surface. On the contrary, when light impinges on a diffuse surface the reflectivity has a substantially weaker dependence on the polarization. Thus, the reflectivity is described as a function of the incident and final polarization according to the following formula:

$$R=R\ (\epsilon_i,\ \epsilon_f,\ \theta_i) \tag{1}$$

where: the incident polarization=$\epsilon_i$; the final polarization=$\epsilon_f$; and the angle of incidence of the reflected light ray=$\theta_i$.

Thus, by using $\epsilon_i$="p", and by varying a polarization in front of the detection fiber to analyze $\epsilon_f$, it is possible to distinguish between the location of the scratch card covered by latex and the uncovered, underlying locations. As a result, the polarization contrast is defined by the formula:

$$C = 1 - \left[\frac{R(\epsilon_i, "p") - R(\epsilon_i, "s")}{R(\epsilon_i, "p") + R(\epsilon_i, "s")}\right] \tag{2}$$

Figure 11:
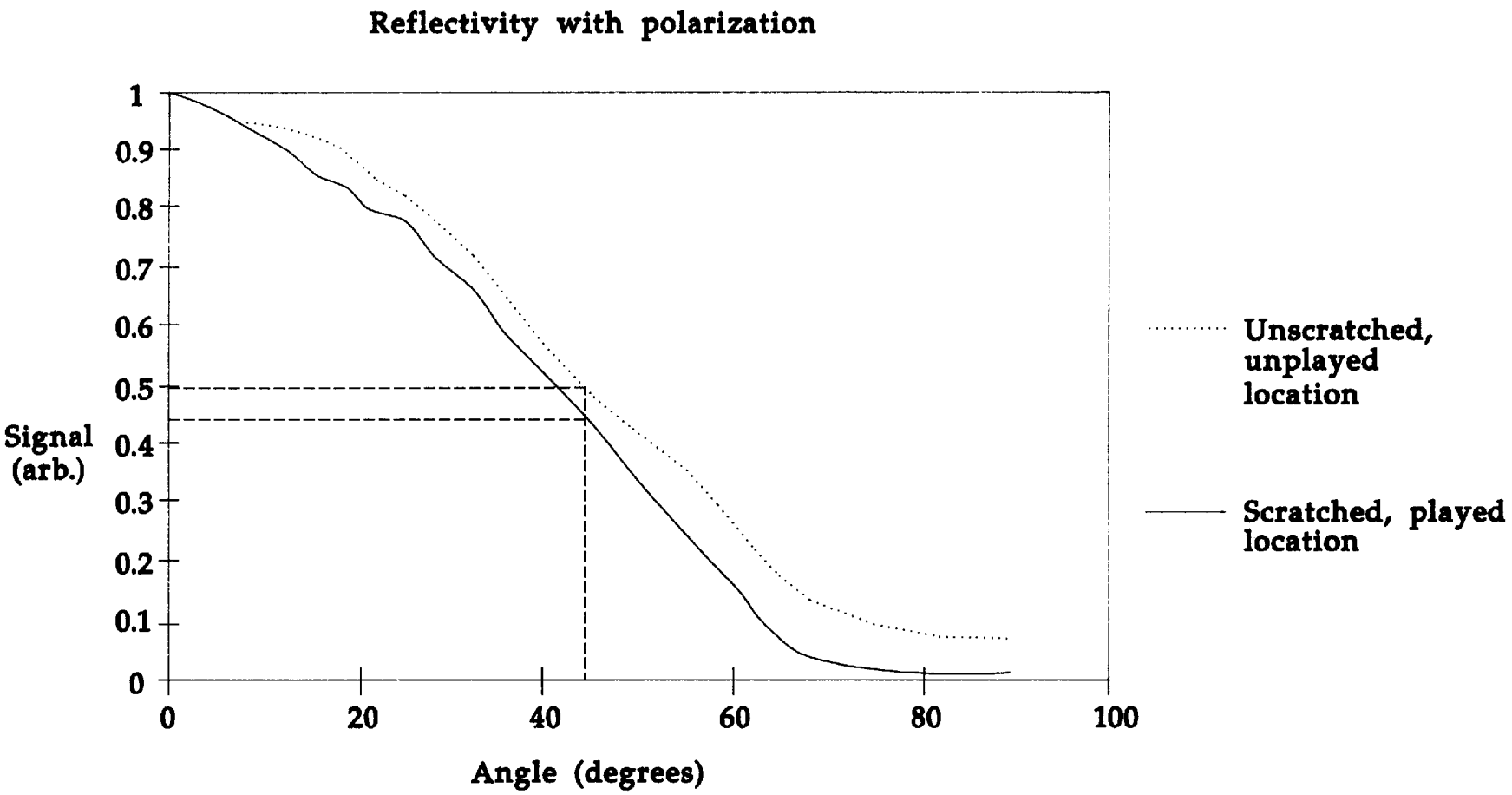
FIG. 11 is a graph of a polarization contrast for played and unplayed locations according to the present invention.

FIG. 11 shows the polarization contrast for an instant lottery scratch card 1 which is reflecting a light ray emitted at 45° angle of incidence (AOI). As seen in FIG. 11, the resulting polarization contrast for the unscratched and unplayed, latex covered locations is about 51%, while the polarization contrast for the scratched and played, underlying locations is about 44%. While the polarization contrast values change for different AOIs, the basic principle is constant, that the difference in "p" and "s" reflectivities is always greater for the scratched and played, underlying locations.

Figure 12A:
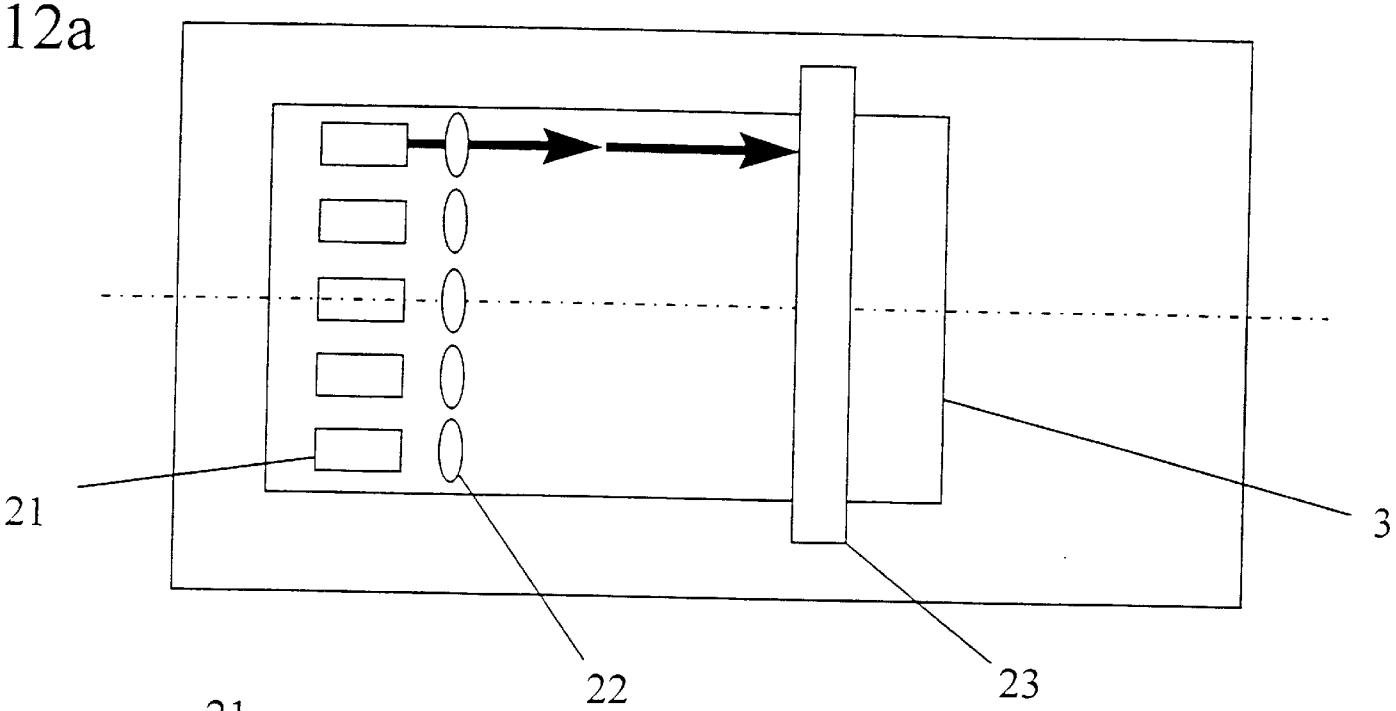
FIG. 12*a* is a plan view of a third embodiment of an apparatus for measuring scattering angles according to the present invention.
Figure 12B:
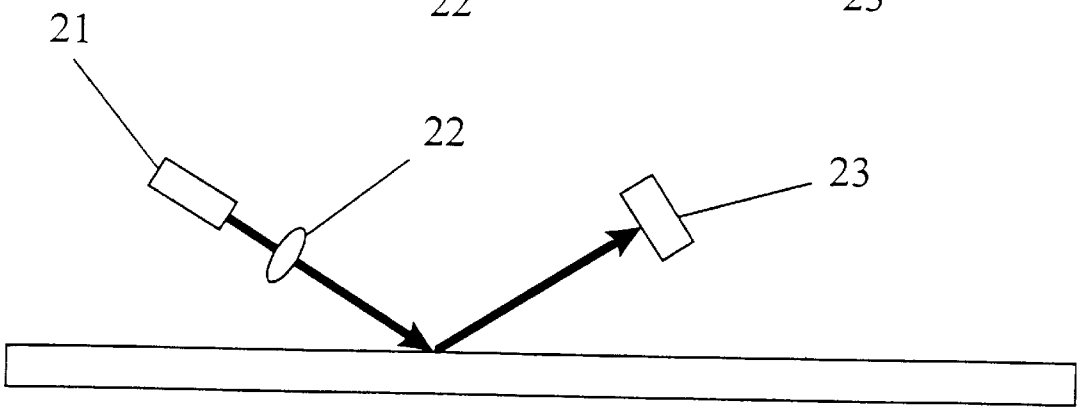
FIG. 12*b* is a side view of the third embodiment of an apparatus for measuring scattering angles according to the present invention.

Another embodiment of the apparatus for evaluating the scattering angles of the instant lottery scratch cards 1 is depicted in FIGS. 12*a* and 12*b*. The embodiment of FIGS. 12*a* and 12*b* replaces the laser diode 13 of FIGS. 7 and 9 with an electrically scanned array of light emitting diodes (LEDs) 21. Each LED 21 is pulsed at a different time thus allowing any line on the card to be evaluated. A transport mechanism (not shown), for example a motor and rollers, pulls the scratch card 1 across the scanned line in order to map out the card in two-dimensions. A beam of light emitted by each LED in the array of LEDs 21 is imaged by a lens 22 onto the scratch card 1 to produce a reflected light beam which is detected by a detector array 23. Preferably, the detector array 23 is a 32 element photodiode array. In addition to each lens 22, an aperture (not shown) is disposed in front of each LED in the array of the LEDs 21 to give each LED sharp edges in the image plane on the detector array 23. The light emitted from each LED in the array of LEDs 21 hits the reflective surface of the scratch card 1 in or near the Fourier transform plane of each of the lens 22. The image plane at the detector array 23 is, therefore, the far-field of the beam, which allows direct determination of the angular scattering measurements from the amplitude of the light along the array. As a result, the detector array 23 measures the sharpness of the image of each LED in the array of LEDs 21.

It is noted that in the embodiments depicted in FIGS. 7, 9, and 12*a,* each apparatus is an all-optical embodiment. Thus, each apparatus is a non-contact device as opposed to an electrical resistance measurement device as in the prior art. Additionally, alternate embodiments of the validation apparatus of the present invention may include different light sources, optics, and detectors than those shown in FIGS. 7, 9, 12*a,* and 12*b*. For example, the laser diode 13 of FIG. 7 and 9 may be replaced by other light sources. As shown in FIG. 12*a,* the laser diode 13 was replaced by the array of LEDs 21. Alternatively, any type of light emitting diode or lamp (incandescent or arc) may be employed. Optics may include a single imaging lens for each light emitter, or a more complex arrangement may be employed. Detector arrays may include single element detectors, or one or two-dimensional arrays such as a Charge-Coupled Device (CCD), a diode array, and a Complimentary Metal-Oxide Semiconductor (CMOS) phototransistor array.

Further considerations in designing the system to measure the scattering angle of reflection of the instant lottery scratch card 1 are the variation in the color of ink used in the latex layer and the variations in the color of ink and pattern appearing underneath the latex layer. These variations in ink can introduce an error into the measurement of the spectral signature of the played and the unplayed locations within the game play area 3 of the scratch card 1.

Each of the embodiments of the present invention minimizes errors due to these variations. In the first embodiment, depicted in FIG. 7, the average scattering angle $\theta_{savg}$ is measured at the at least one location within the scratch card's game play area 3, and not the absolute reflectivity of the surface. Additionally, all angular scattering measurements are normalized so that the absolute reflectivity does not introduce errors into the calculation of the average scattering angle $\theta_{savg}$. Similarly, the embodiment depicted in FIGS. 12*a* and 12*b* measures the average scattering angle $\theta_{savg}$ as opposed to the absolute reflectivity of the surface, and normalizes all angular scattering measurements. In the embodiment of FIG. 9, the polarization angle and not the absolute reflectivity of the scratch card 1 is measured at each point. All measurements of scattering angles of polarized light are also normalized so that the absolute reflectivity is removed when calculating the polarization contrast.

Figure 13:
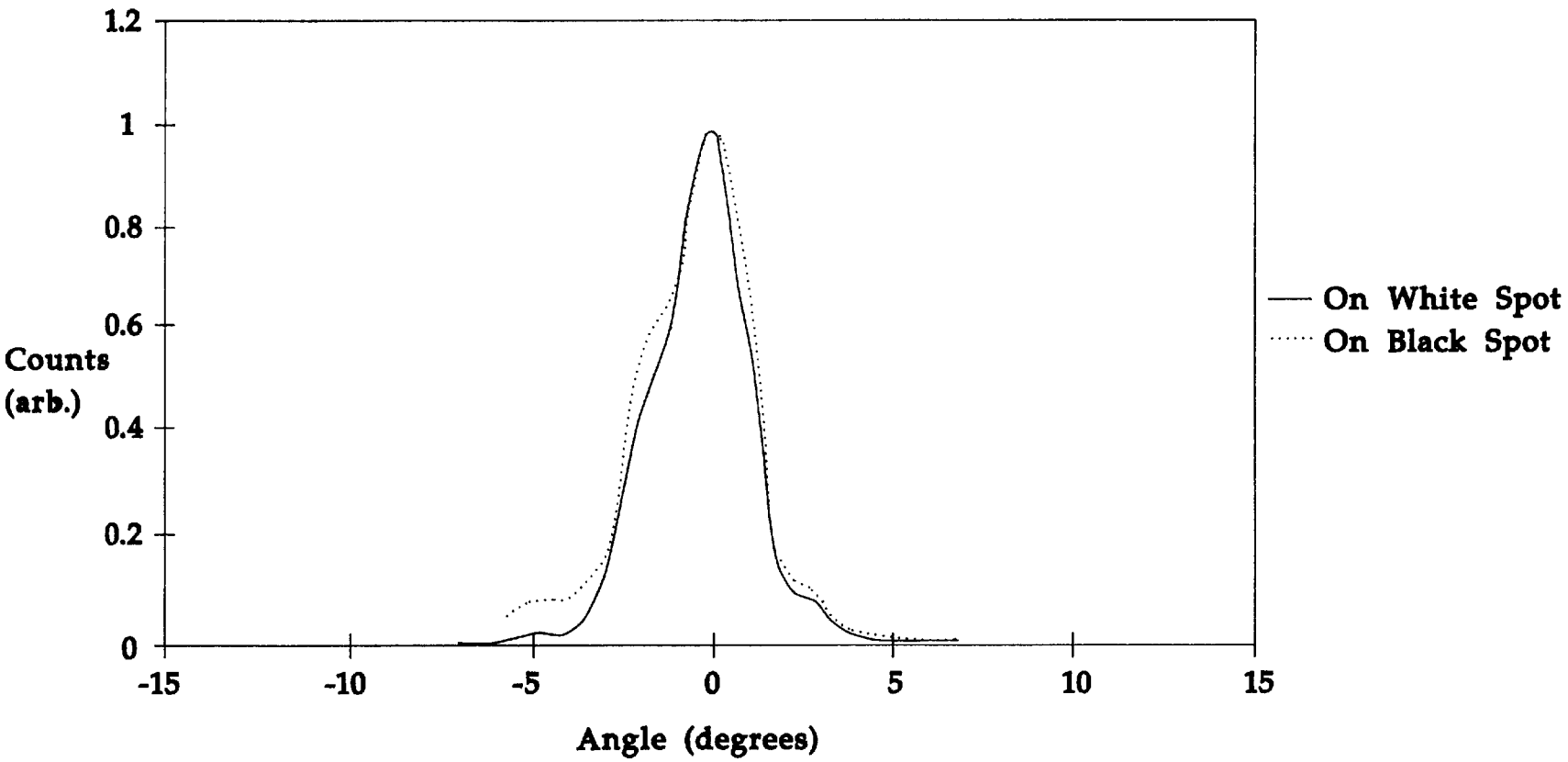
FIG. 13 is a graph of the scattering angles measured for two played locations by the apparatus according to the first embodiment of the present invention.

FIG. 13 illustrates a graph of the angular scattering measurements obtained from two played locations on a scratch card 1 by the apparatus of FIG. 7. The two played locations of the scratch card 1 represent a first played location in which the latex 4 has been removed to reveal a black surface color and a second played location in which the latex 4 has been removed to reveal a white surface color. As shown in FIG. 13, the angular scattering measurements of the black and the white surface colors are substantially the same when their peaks are normalized to unity. It is also noted that the absolute reflectivity of each location can be measured by tracking the absolute signal from the detector array 23 during each measurement. Optionally, the absolute reflectivity may be used as a further validation signal by comparing the measured absolute reflectivity to a predetermined absolute reflectivity for a particular scratch card.

Figure 14A:
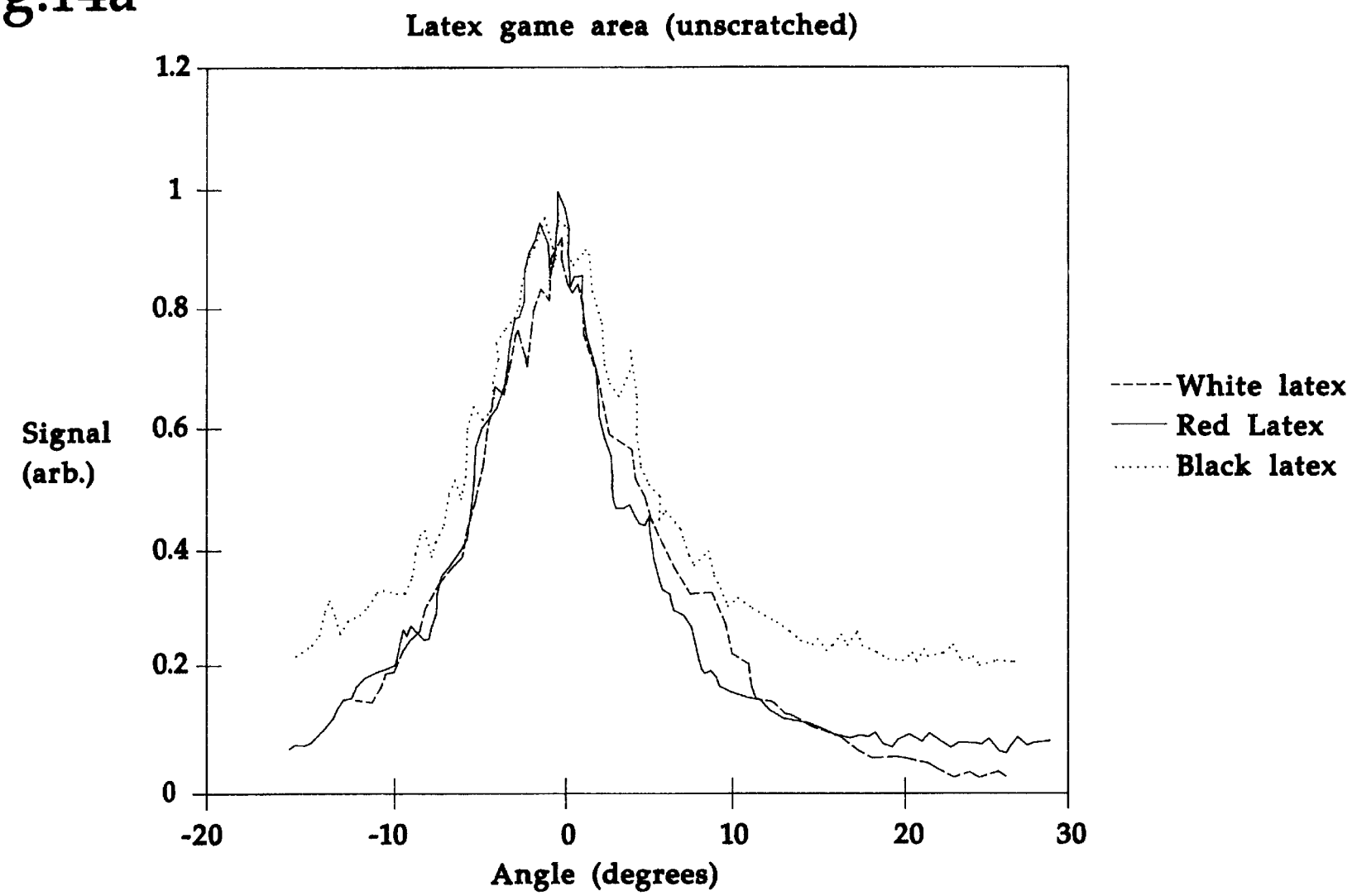
FIG. 14*a* is a graph of the scattering angles measured for three unplayed locations whose latex layer are of different color inks.
Figure 14B:
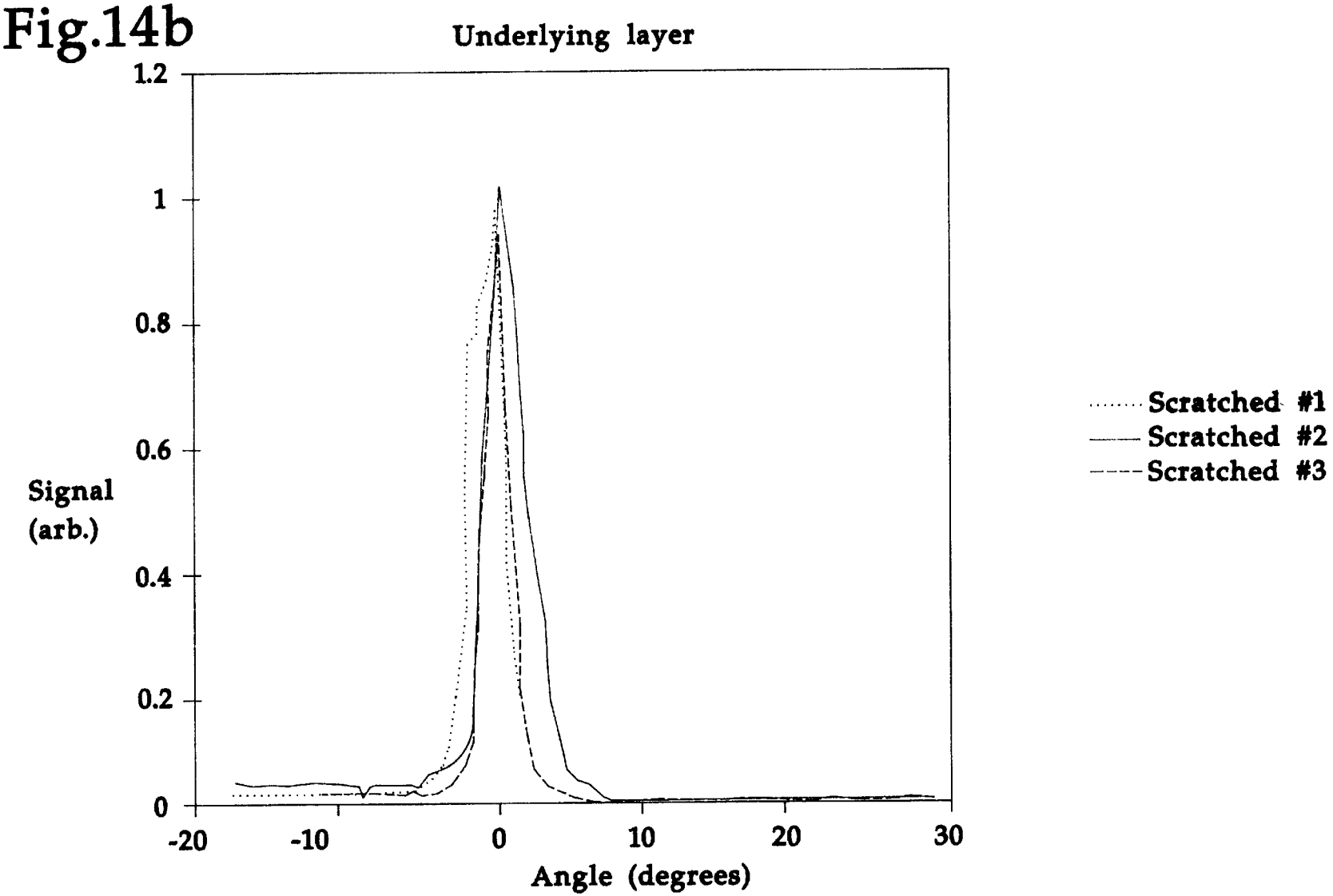
FIG. 14*b* is a graph of the scattering angles measured for three played locations whose latex layer were of different color inks.
Figure 14C:
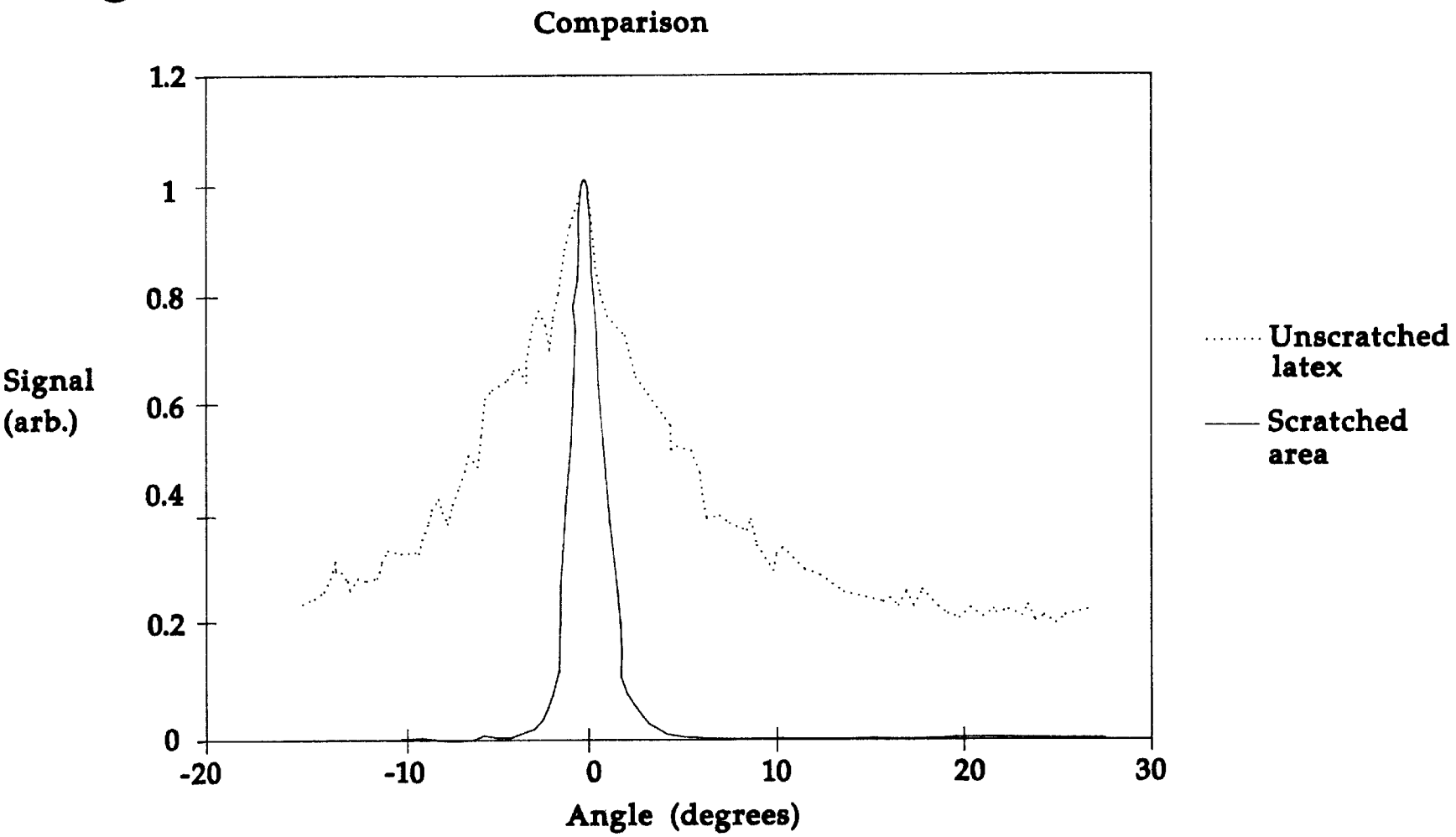
FIG. 14*c* is a graph comparing the scattering angles measured for one played and one unplayed location of a scratch card.

FIG. 14*a* illustrates a graph of the angular scattering measurements obtained from unplayed, unscratched locations on scratch cards having different latex colors. Specifically, FIG. 14*a* illustrates subtle changes in the angular scattering measurements due to the fact that the latex layer of each scratch card contains different colorings of ink. In FIG. 14*b,* each of these scratch cards shown in FIG. 14*a* are again evaluated. However, in FIG. 14*b,* the latex layer has been removed and the angular scattering measurements obtained from the played, scratched locations. In FIG. 14*c,* a comparison is shown between the angular scattering measurements of the latex layer and the angular scattering measurements of the underlying layer, i.e. the layer exposed after the latex is removed. The angular scattering measurements plotted in FIGS. 14*a*–14*c* are summarized in Tables 2a and 2b below. Tables 2a and 2b summarize the full-width-half-max (FWHM) angular function widths for the latex layer and the underlying layer, respectively. As demonstrated by the data in Tables 2a and 2b, the underlying layer has scattering full-width angles of about 2–3 degrees, and the latex layer has scattering full-width angles of about 8–12 degrees.

TABLE 2a

| Latex Layer | |
|---|---|
| Angle (FWHM, degrees) | Color on Latex |
| 11.5 | White |
| 8.5 | Red |
| 9.8 | Black |

TABLE 2b

| Underlying Layer | |
|---|---|
| Angle (FWHM, degrees) | Color on Latex |
| 2.5 | White |
| 3 | Red |
| 2.1 | Black |

Further in accordance with the present invention, the lottery ticket scratch cards 1 are marked to indicate that the scratch card has been read once before. The scratch cards 1 are marked as read to prohibit the card from being "played again". That is, to prevent a subsequent evaluation of the scratch card 1 which could result in the issuance of a duplicate prize, or to prevent the card from being scanned before purchase in an attempt to determine if the card is a winning card.

In a first technique, referred to as a read once marking technique, one or more chemical components are added to the scratch card 1. The one or more chemical components are added either to the ink of an existing game play area 3, or the scratch card 1 is coated with the chemical components in a designated area. The one or more chemical components are initially colorless and non-fluorescent. At the time the card is scanned, the one or more chemical components are automatically activated. The automatic activation occurs when a flash of light from a scratch card reader in the lottery terminal triggers an irreversible reaction which produces one or more fluorescent materials with distinct wavelengths. Once activated, the one or more chemical components create a specific bit. That is, the one or more automatically activated chemical components exhibit a unique color that is detectable by human observation and a fluorescence signature that is detectable by machine.

Figure 15:
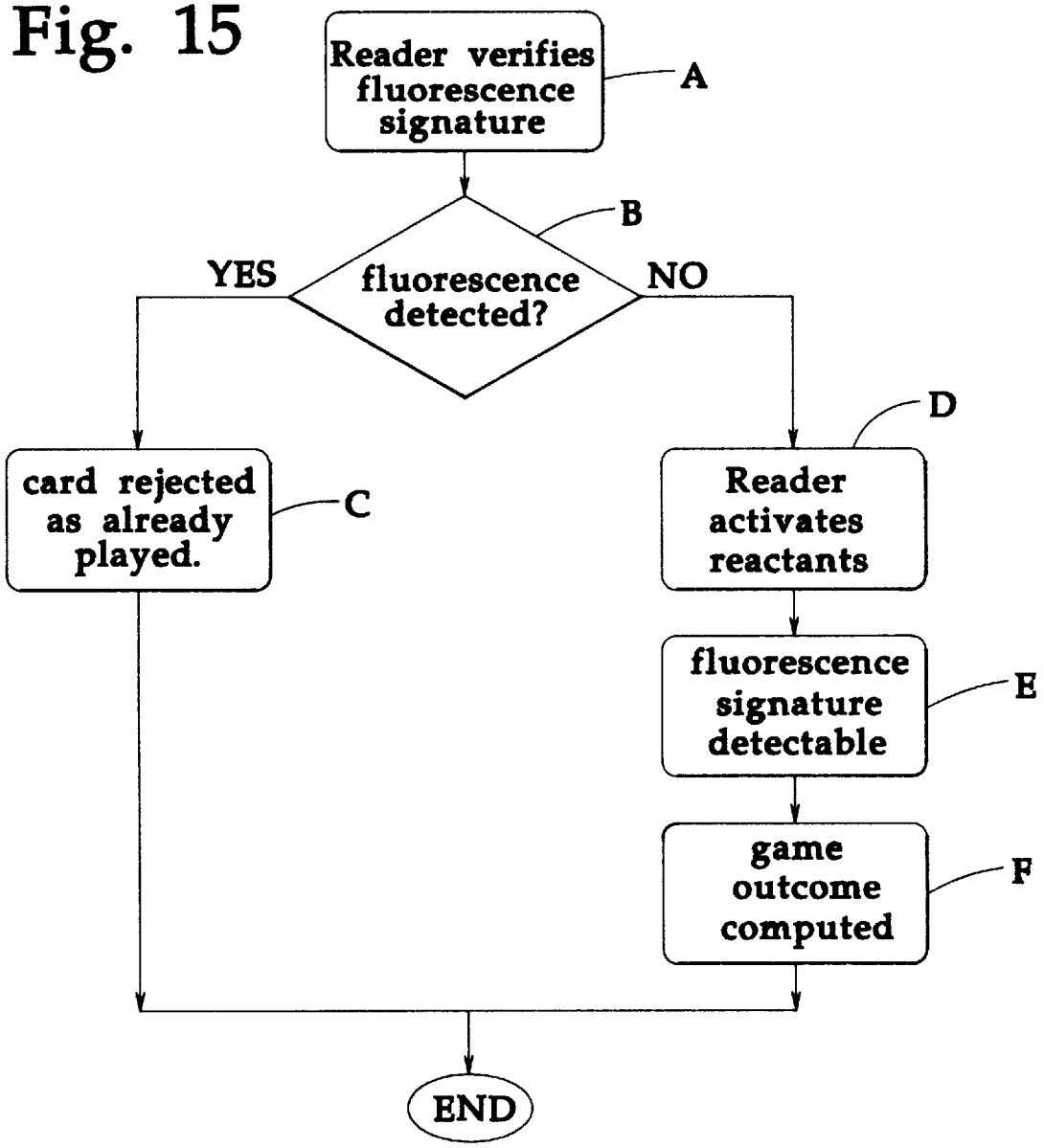
FIG. 15 is a flow chart of the operation of a read once marking technique in accordance with the present invention.

A flow chart detailing the operation of the read once marking technique is shown in FIG. 15. First, at Block A, a validator within the scratch card reader verifies that the scratch card has not already been read. The validator accomplishes this by reading the scratch card with a low-level light source, i.e. a light source having a different wavelength than the flash of light which automatically activates the one or more chemical components. The low-level light source detects whether a fluorescent emission, i.e. the fluorescence signature, is already present. At Block B, if the fluorescent emission is present then the "YES" path is followed for the scratch card has already been read once before and, therefore, the scratch card is rejected at Block C. Because the scratch card has already been read, the flash of light is not emitted. However, if the fluorescent emission is not detected, the "NO" path from Block B is followed to Block D where the scratch card reader automatically activates the one or more chemical components. As mentioned above, activation of the one or more chemical components is accomplished when the scratch card reader, at Block D, emits the flash of light. As shown at Block E, the fluorescent emission is now detectable. The read once marking technique is completed by computing the game outcome at Block F.

As described above, one or more fluorescent materials remain which are detectable by a subsequent read of the scratch card 1 or by a color change which is visible to human observation. The flash of light which activates the one or more chemical components is preferably an ultraviolet (uv) light which is not present in appreciable quantity in room or sunlight. Preferably, the one or more chemical components include, for example, Crevelo Salt and a colorless lactone dye. The incident uv light activates the Crevelo Salt to form a protic acid. When the protic acid interacts with the colorless lactone dye, the combination forms a unique color and fluorescence signature. The protic acid and the colorless lactone dye may, for example, be additives to existing game play area ink or disposed in a distinct area on the scratch card ticket. Alternatively, the paper card stock 2 of the scratch card 1 may contain an ultraviolet-responsive protic acid generator which, when illuminated by the flash of uv light, releases the protic acid to interact with the colorless lactone dye to form the unique color and fluorescence signature. It is also preferable that the dye lactone used for the read once purpose differs from those used for the latex layer anti-tampering described in detail above.

In a second marking technique, referred to as a branding technique, a thermochromic material and a fluorescent material are intermingled to create a "thermofluorescent" material or coating which irreversibly changes its fluorescence signature upon heating. Preferably, the thermofluorescent material or coating includes a binder such as an organic polymer and one or more additives. The additives include a fluoropore such as an organic dye molecule, a thermochromic material such as a well-known silver soap/developer chemistry, and an optional white pigment such as a titanium dioxide which enhances multiple scattering. Each of the additives may be combined with the binder individually or in any combination. The combination of binder and one or more additives may be combined to form any number of layers on a surface of the scratch card 1, including a single binder with all of the additives forming a single layer.

Once the thermofluorescent material is applied to the surface of the scratch card 1, it forms a hardened film which is fluorescent. The spectral shape and amplitude of the fluorescence coming from the thermofluorescent material is a function of the degree that light which impinges on the hardened film is scattered when leaving the material. As a result of self-reabsorption and re-emission, the fluorescence of the thermofluorescent material is substantially broadened and spectrally shifted due to multiple scattering. Any change in the multiple scattering, for example, a change in the absorption, causes a change in the fluorescence signature of the thermofluorescent material.

Figure 16:
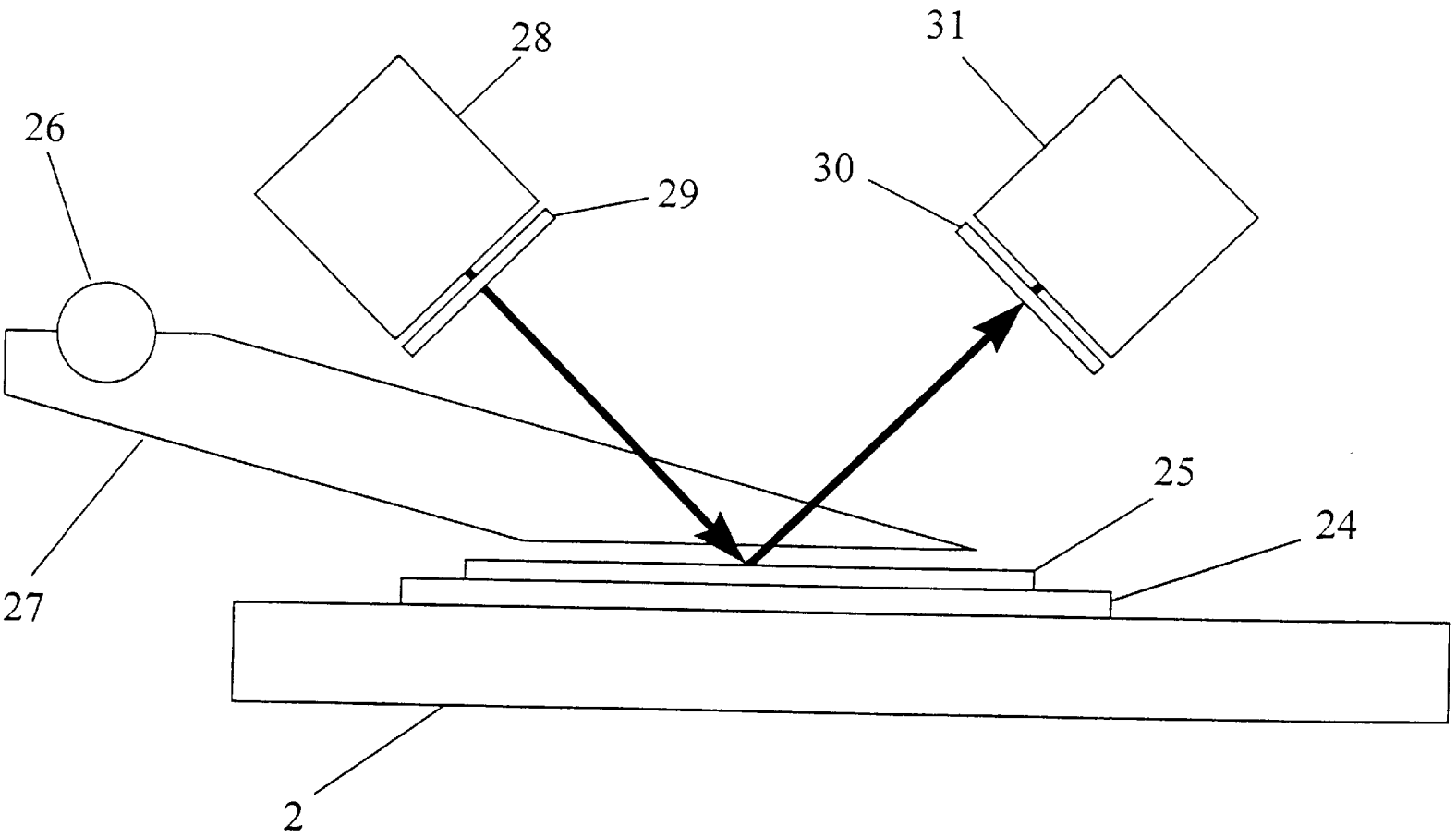
FIG. 16 is a schematic diagram of a scratch card marking apparatus in accordance with the present invention.

FIG. 16 illustrates, an apparatus for branding a thermofluorescent material disposed upon an instant lottery scratch card. FIG. 16 shows a two-layer thermofluorescent material including a binder 24 and an additive 25 disposed upon the scratch card stock 2. The preferred composition of the two-layer thermofluorescent material is described below in Table #3.

TABLE 3

Preferred Composition of Two-layer Thermofluorescent Material

| Material | Concentration (mg/cc) |
|---|---|
| Layer 1: | |
| Cellulose acetate butyrate | 150 |
| 3,4 Dihydroxybenzoic acid | 10 |
| Layer 2: | |
| Cellulose acetate butyrate | 150 |
| Ag behentate | 45 |
| TiO2 | 50 |
| Rhodamine B base | 0.5 |
| Solvent: | |
| Ethyl acetate | 1 cc |

Additionally, FIG. 16 shows a branding element 27 coupled to a power supply 26. Preferably, the branding element 27 is a tungsten coil and the power supply 26 is a 6 volt, 2 amp power supply. Also shown in FIG. 16 is a light source 28 which, when activated, emits a beam of light through a filter 29 to illuminate the thermofluorescent material disposed on the scratch card 1. Upon illumination, the thermofluorescent material emits a fluorescent emission. The fluorescent emission is detected by a detecting device 31 after being filtered by a second filter 30. For example, the light source 28 is a Welch Allyn Lamp and the detecting device 31 is a Welch Allyn 4400 Image Team Barcode Reader.

Figure 17:
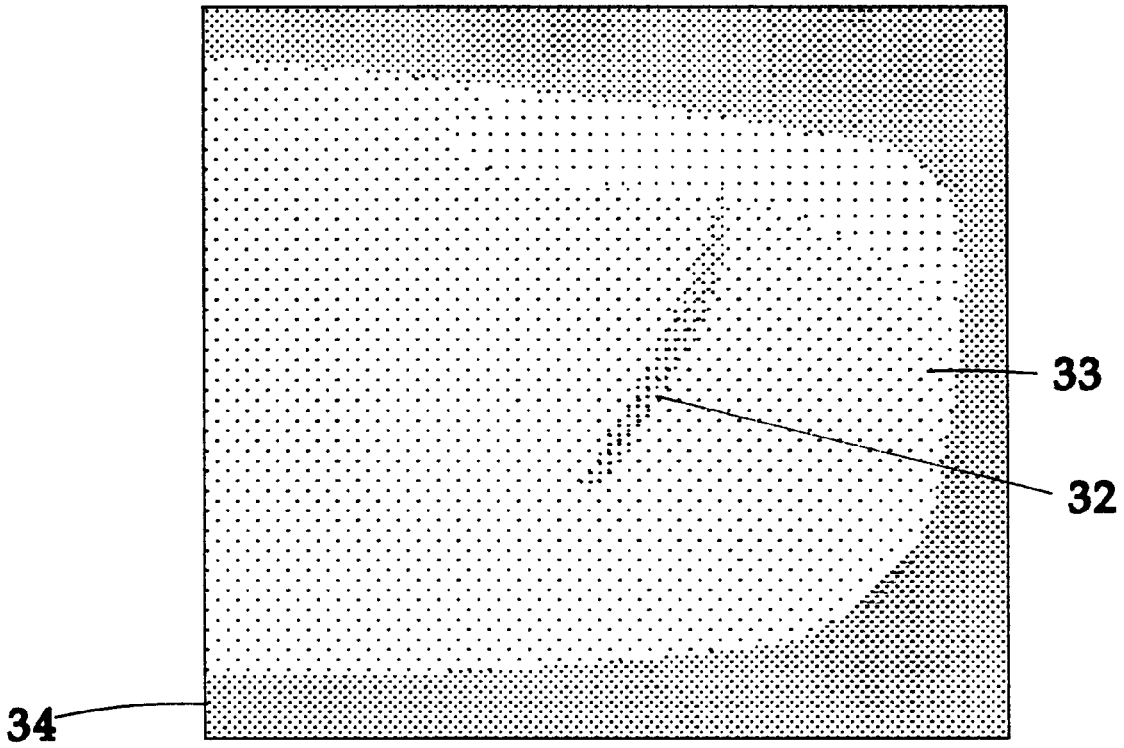
FIG. 17 is a graph of the fluorescence image from a branded thermofluorescent material disposed on a scratch card instant lottery ticket.

In operation, the power supply 26 is activated to heat the branding element 27. The branding element 27 is then placed in proximity to the thermofluorescent material for a period of time to heat the thermofluorescent material. The period of time required for marking the thermofluorescent material was found to be from about 0.3 to 0.5 seconds. After marking, the light source 28 is then activated to emit the beam of light through the filter 29 to illuminate the thermofluorescent material disposed on the scratch card 1. The fluorescent emission emitted by the thermofluorescent material is detected by the detecting device 31 after being filtered by the second filter 30. A fluorescence image of the fluorescent emission is shown in FIG. 17. As shown in FIG. 17, a branding mark is represented by a dark stripe 32 in the fluorescence image of the fluorescent emission emitted by the thermofluorescent material. The dark stripe 32 is an area of non-fluorescence within the fluorescence image. The lighter area 33 is the fluorescence of the unbranded portion of the thermofluorescent material as it appears in the fluorescent image of the fluorescent emission from the thermofluorescent material. The dark border 34 is the non-fluorescent scratch card 1.

Figure 18:
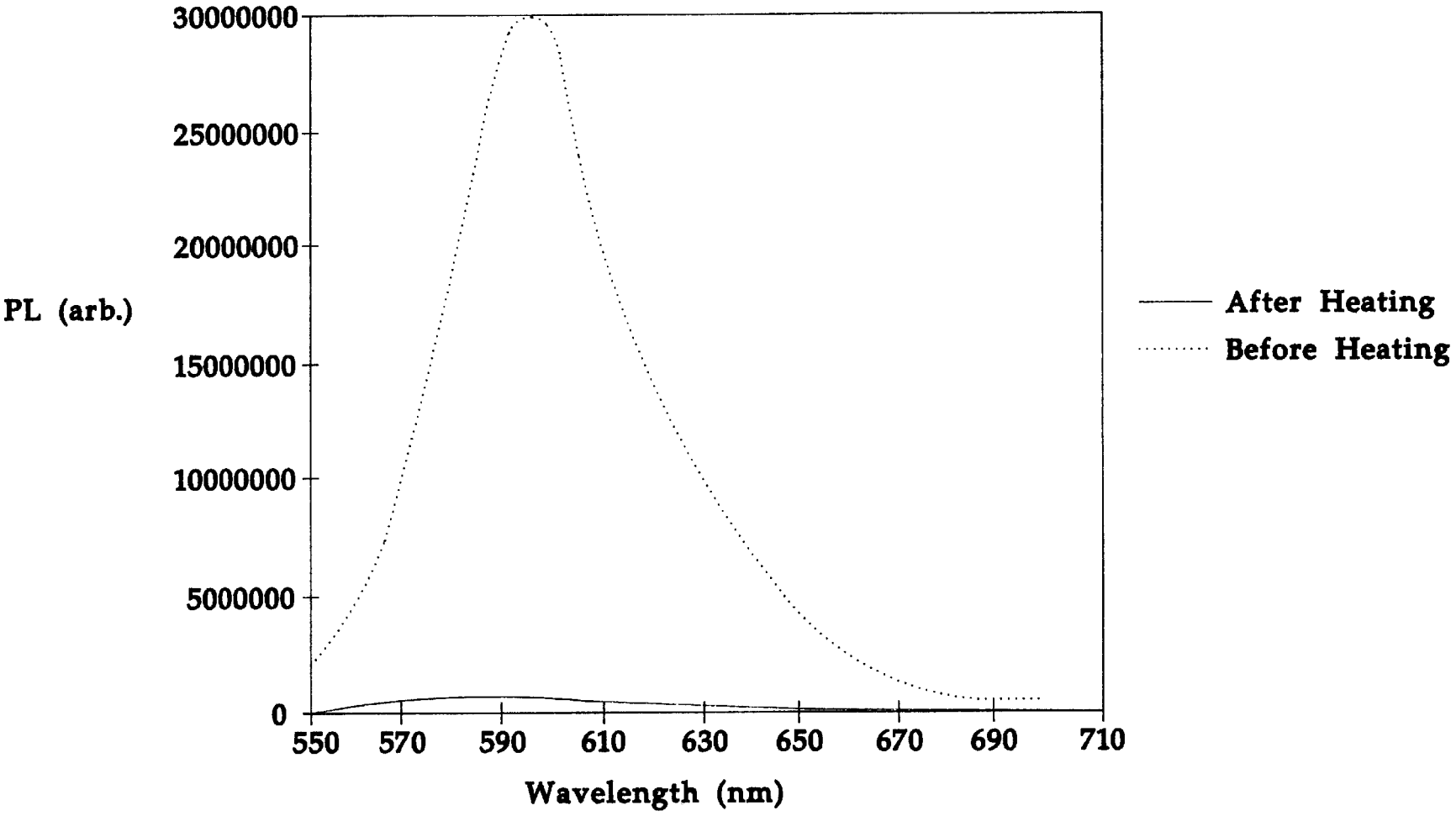
FIG. 18 is a graph of a non-normalized fluorescence spectrum from both a branded and an unbranded thermofluorescent material disposed on a scratch card instant lottery ticket.
Figure 19:
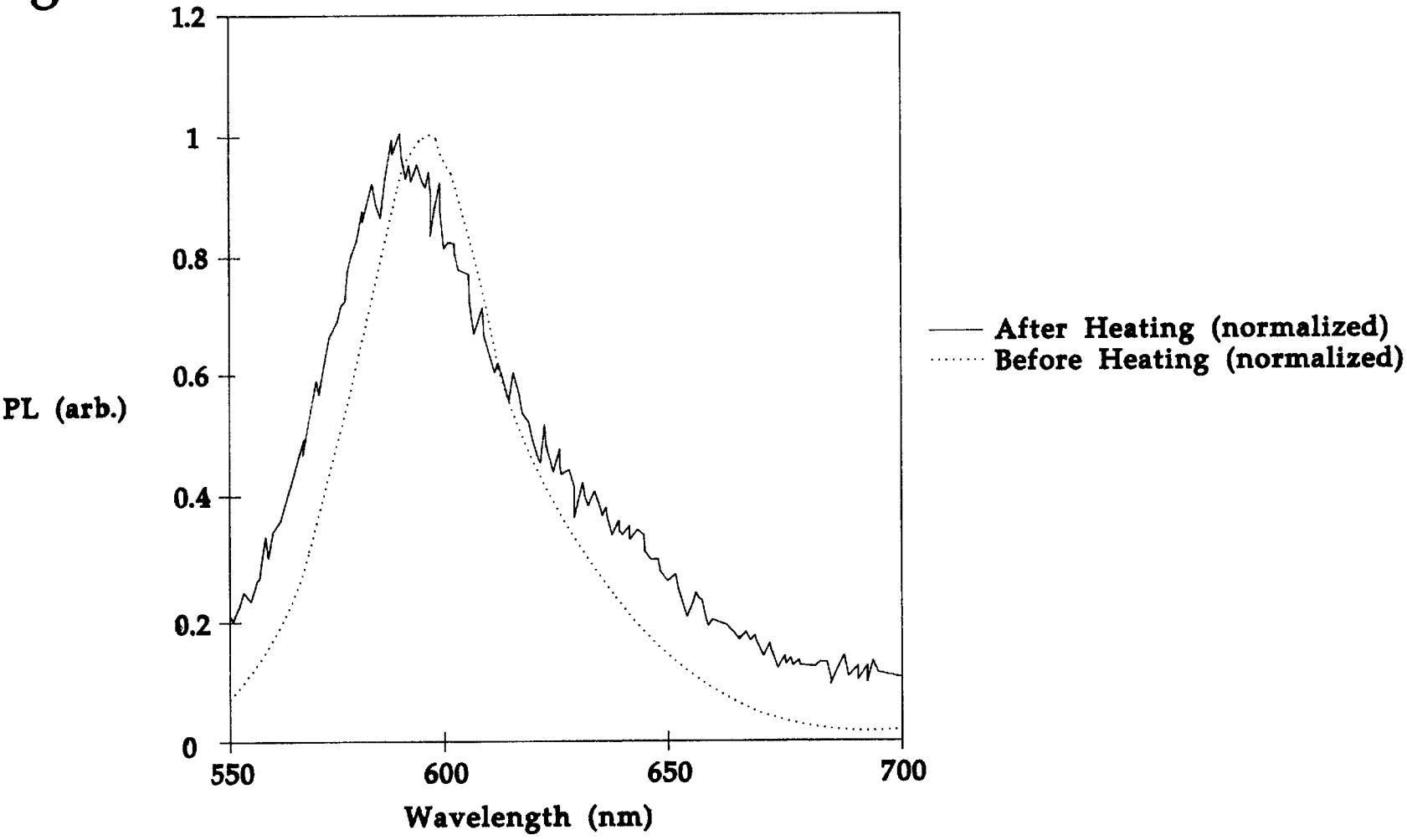
FIG. 19 is a graph of a normalized fluorescence spectrum from both a branded and an unbranded thermofluorescent material disposed on a scratch card instant lottery ticket.

As shown in FIGS. 18 and 19, the fluorescent amplitude of the thermofluorescent material is reduced by more than an order of magnitude when heat is applied locally to the material. In FIG. 18, the fluorescence spectrum is not normalized to demonstrate the relative intensity change before and after branding. In FIG. 19, the fluorescence spectrum is normalized to show the shift and broadening of the spectrum after heating.

It can be appreciated that the use of the thermofluorescent material in accordance with an aspect of this invention can provide both a visible and a machine readable indication that a particular a particular scratch card has been previously validated. That is, the thermally induced darkening of the thermochromic material component, while significantly affecting the fluorescent emission of the fluorescent component, is also visible to the human eye.

In one embodiment of this marking technique, a material responsive to heat, i.e. the thermofluorescent material, is added to the surface of the card paper stock 2 in proximity to the security or identification information, i.e. the bar code. As the bar code is scanned by a bar code reader, the surface of the material is also scanned. When the surface of the material is scanned, light emitted by the bar code reader is reflected. The reflected components of the emitted light is detected by the bar code reader. In this process one can also perform a check on the thermofluorescent material.

In yet another embodiment of irreversible marking, light reflected from a smooth surface produces a large component of specular light, while light reflected from a rough surface produces a large diffuse component. Initially, a surface texture of the material added to the paper card stock is smooth. When the bar code reader scans the material with the smooth surface texture, a large component of specular light is detected. If the material is heated, however, the surface texture changes from the smooth texture to a rough surface texture. When the bar code reader scans the material after heating, a large component of diffuse light is detected. Therefore, by changing the surface texture of the material the scratch card 1 is marked as having been read once before.

In accordance with this embodiment of the invention a material is added to the surface of the card paper stock 2, such as a polymer (e.g., polystyrene), which when heated releases a gas. The generation of the gas occurs in a surface or internal layer of the material. When the material is heated, some of the gas escapes from the layer. The escaping gas disrupts the surface smoothness of the material, resulting in a detectable decrease of specular reflection and an increase in scattering.

While the invention has been particularly shown and described with respect to preferred embodiments thereof, it will be understood by those skilled in the art that changes in form and details may be made therein without departing from the scope and spirit of the invention.

What is claimed is:

1. A document comprising:

a surface; and a thermofluorescent material comprised of a thermochromic material in combination with a fluorescent material that is applied to said surface, wherein said thermofluorescent material has a first fluorescence signature when illuminated by light having predetermined wavelengths;

wherein when said thermofluorescent material is heated, said first fluorescence signature is irreversibly altered to a second fluorescence signature by a change of state of said thermochromic material, wherein said thermofluorescent material further comprises a binder and one or more additives that are applied to said surface as a plurality of layers.

2. A document as in claim 1, wherein said binder is comprised of an organic polymer.

3. A document as in claim 1, wherein said one or more additives is comprised of a pigment for enhancing a scattering of an emission from said thermofluorescent material.

4. A document as in claim 3, wherein said pigment is comprised of titanium dioxide.

5. A document as in claim 1, wherein said one or more additives is comprised of an organic dye.

6. A document as in claim 1, wherein said one or more additives is comprised of a silver soap/developer.

7. A document as in claim 1, wherein said document is a scratch card instant lottery ticket, and wherein said heating irreversibly alters said first fluorescence signature to said second fluorescence signature to identify said scratch card instant lottery ticket as a played scratch card ticket.

* * * * *